US006718922B2

(12) United States Patent
Yasui

(10) Patent No.: US 6,718,922 B2
(45) Date of Patent: Apr. 13, 2004

(54) CAM PHASE CONTROL APPARATUS AND METHOD, AND ENGINE CONTROL UNIT FOR INTERNAL COMBUSTION ENGINE

(75) Inventor: Yuji Yasui, Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/299,311

(22) Filed: Nov. 19, 2002

(65) Prior Publication Data

US 2003/0094151 A1 May 22, 2003

(30) Foreign Application Priority Data

Nov. 19, 2001 (JP) ..... 2001-353278

(51) Int. Cl.[7] ..... F01L 1/34
(52) U.S. Cl. ..... 123/90.17; 123/90.15; 123/90.11; 701/102
(58) Field of Search ..... 123/90.11–90.18, 123/90.31; 706/932, 905; 701/101, 102, 105, 106, 115

(56) References Cited

U.S. PATENT DOCUMENTS 5,363,817 A * 11/1994 Ikeda et al. ..... 123/90.15
5,937,806 A * 8/1999 Lyko et al. ..... 123/90.15
5,937,808 A * 8/1999 Kako et al. ..... 123/90.15
6,431,131 B1 * 8/2002 Hosoya et al. ..... 123/90.15
6,488,008 B1 * 12/2002 Jankovic et al. ..... 123/399

* cited by examiner

*Primary Examiner*—Thomas Denton
*Assistant Examiner*—Kyle Riddle
(74) *Attorney, Agent, or Firm*—Lahive & Cockfield, LLP; Anthony A. Laurentano

(57) ABSTRACT

A cam phase control apparatus for an internal combustion engine is provided for improving the controllability in a transient state in which an actual cam phase converges to a target cam phase to accurately and readily identify model parameters even when a mechanism for changing the actual cam phase exhibits an intense friction characteristic. The cam phase control apparatus relies on a sliding mode control algorithm which models a controlled object that receives the control input to a cam phase varying device and outputs an actual cam phase as a discrete time based model, and creates a switching function as a function of time series data of a following error. An ECU functions as a sliding mode controller for determining the control input to the cam phase varying device at a predetermined control period for converging the actual cam phase to a target cam phase.

140 Claims, 11 Drawing Sheets

FIG. 5

$$DUT(k) = Usl(k) = Ueq(k) + Urch(k) + Unl(k) + Uadp(k) \quad \cdots\cdots (6)$$

$$Ueq(k) = \frac{1}{b1}\{(1-a1-S')\cdot CAIN(k) + (S'-a2)\cdot CAIN(k-5) + CAINCMD(k+5) + (S'-1)\cdot CAINCMD(k) - S'\cdot CAINCMD(k-5)\} \quad \cdots\cdots (7)$$

$$Urch(k) = \frac{-F}{b1}\sigma'(k) \quad \cdots\cdots (8)$$

$$Uadp(k) = \frac{-G'}{b1}\sum_{i=0}^{k}\Delta T\cdot\sigma'(i) \quad \cdots\cdots (9)$$

$$Unl(k) = \frac{-H'}{b1}\mathrm{sgn}(\sigma'(k)) \quad \cdots\cdots (10)$$

WHERE F, G', H' REPRESENT GAINS, RESPECTIVELY

CAM PHASE CONTROL APPARATUS AND METHOD, AND ENGINE CONTROL UNIT FOR INTERNAL COMBUSTION ENGINE

BACKGROUND OF THE INVENTION

1. Field of the Invention

The present invention relates generally to a cam phase control for an internal combustion engine, and more particularly, to a cam phase control apparatus and method, and an engine control unit for an internal combustion engine which rely on a response specifying control algorithm to control an actual cam phase of an intake cam and/or exhaust cam with respect to a crank shaft to converge the actual cam phase to a target cam phase.

2. Description of the Prior Art

A conventional cam phase control apparatus of the type mentioned above is known, for example, from Laid-open Japanese Patent Application No. 2001-132482. An internal combustion engine associated with the cam phase control apparatus comprises a cam phase varying device for changing an actual cam phase of an intake cam. The cam phase varying device comprises a hydraulically driven cam phase varying mechanism, an electromagnetic control valve for supplying the cam phase varying mechanism with an oil pressure from an oil pump, and the like. The cam phase control apparatus in turn comprises a crank angle sensor and a cam angle sensor for detecting signals corresponding to angular positions of a crank shaft and an intake cam, respectively, and a controller which receives the signals detected by these sensors. The controller calculates an actual cam phase based on the signals detected by the crank angle sensor and cam angle sensor, calculates a target cam phase based on an operating condition of the internal combustion engine, and controls the actual cam phase to converge to the target cam phase based on a sliding mode control algorithm which is one type of the response specifying control algorithm.

Specifically, the sliding mode control algorithm models, as a continuous time based model, a controlled object which includes the cam phase varying mechanism and the electromagnetic control valve, and receives a control input to the electromagnetic control valve and outputs a calculated actual cam phase. More specifically, a state equation representative of the controlled object is set as a differential equation which has state variables that represent a first and a second time derivative value of the actual cam phase. A switching function is additionally set as a linear function which has a state variable that represents a deviation of the actual cam phase from the target cam phase, and a time-derivative value (i.e., a changing rate) of the deviation. Then, a control input is calculated such that the deviation and changing rate thereof represented by the state variables of the switching function set in the foregoing manner rest on a switching line, i.e., the control input is calculated such that the deviation and changing rate thereof slide on the switching line to converge to zero, thereby controlling the actual cam phase to converge to the target cam phase.

Generally, the hydraulically driven cam phase varying mechanism exhibits an intense friction characteristic, so that the conventional cam phase varying device preferably controls such a controlled object at a control period as short as possible from a viewpoint of improving the controllability. In addition, since the target cam phase is calculated based on an operating condition of the internal combustion engine, its power spectrum exists in a much lower frequency region than the frequency corresponding to the control period. This means that since the target cam phase is calculated based on a parameter such as the operating condition, accelerator opening, or the like, which changes at a low rate, the calculated target cam phase also changes at a low rate.

Therefore, in the conventional cam phase control apparatus which employs a changing rate of the deviation of the actual cam phase from the target cam phase as a state variable of the switching function, the target cam phase changing at a low rate causes a slow changing rate of the actual cam phase which is controlled based on the target cam phase, so that the changing rate of the deviation of the actual cam phase from the target cam phase lies in the vicinity of zero, if detected at short time intervals such as the control period, meaning that the deviation will remain unchanged. As a result, the calculated deviation is susceptible to noise, and therefore suffers from a low calculation accuracy. Further, the changing rate of the deviation lies in the vicinity of zero so that the switching function is substantially equivalent to the deviation, resulting in a failure in ensuring the robustness and response specifying characteristic due to difficulties in implementing a sliding mode which is unique to the sliding mode control. From the foregoing, the conventional cam phase control apparatus can fall into low controllability in a transient state in which the actual cam phase converges to the target cam phase, possibly causing the actual cam phase to overshoot the target cam phase, by way of example.

Also, since the conventional cam phase control apparatus models a controlled object as a continuous time based model, it is difficult to directly identify model parameters of the controlled object from data derived from an experiment on the controlled object. For this reason, specifically, the continuous time based model must be approximately converted to a discrete time based model to identify the model parameters based on the approximate conversion. However, the use of such an approximation conversion will cause a degraded identification accuracy of the model parameters. Furthermore, since the discrete time based model is again approximately converted to a continuous time based model, increased modeling errors will introduce into the controlled object model due to the "round-trip" approximation conversions. Consequently, a controller gain must be limited for ensuring a margin for control stability, resulting in degraded controllability.

OBJECT AND SUMMARY OF THE INVENTION

The present invention has been made to solve the problems mentioned above, and it is an object of the invention to provide a cam phase control apparatus and method, and an engine control unit for an internal combustion engine which are capable of improving the controllability in a transient state in which an actual cam phase converges to a target cam phase to accurately and readily identify model parameters even when a mechanism for changing the actual cam phase exhibits an intense friction characteristic.

To achieve the above object, according to a first aspect of the present invention, there is provided a cam phase control apparatus for an internal combustion engine for controlling an actual cam phase of at least one of an intake cam and an exhaust cam with respect to a crank shaft.

The cam phase control apparatus according to the first aspect of the present invention is characterized by comprising cam phase varying means for changing the actual cam phase; cam phase detecting means for detecting the actual cam phase; operating condition detecting means for detecting an operating condition of the internal combustion engine; target cam phase setting means for setting a target cam phase in accordance with the detected operating condition; and control means relying on a response specifying control algorithm to determine a control input to the cam phase varying means at a predetermined control period for converging the actual cam phase to the target cam phase, wherein the response specifying control algorithm is configured to model a controlled object which receives the control input to the cam phase varying means and outputs the actual cam phase, and the controlled object is represented by a discrete time based model.

According to this cam phase control apparatus for an internal combustion engine, since the controlled object is modeled as a discrete time based model in the response specifying control algorithm, model parameters can be more accurately and readily identified in accordance with a general identification algorithm such as a least square method based on data obtained from experiments and simulations than the conventional cam phase control apparatus which relies on a continuous time based model. For the same reason, an on-board identifier can be added to the cam phase control apparatus, in which case the model parameters can be appropriately and readily identified in real time to improve the controllability. Further, for the same reason, no approximate conversion is needed for modeling the controlled object, thereby making it possible to reduce a modeling error of the controlled object model and ensure a larger margin for control stability, as compared with the conventional cam phase control apparatus which relies on the continuous time based model, to ensure a larger controller gain and improve the controllability. Also, for the same reason, the cam phase control apparatus of the present invention can accurately specify convergence of the output of the controlled object to a target value, and a frequency response of the output (for example, H control and the like), as authentically intended by the response specifying control algorithm.

To achieve the above object, according to a second aspect of the present invention, there is provided a cam phase control apparatus for an internal combustion engine for controlling an actual cam phase of at least one of an intake cam and an exhaust cam with respect to a crank shaft.

The cam phase control apparatus according to the second aspect of the present invention is characterized by comprising a cam phase varying device for changing the actual cam phase; a cam phase detecting module for detecting the actual cam phase; an operating condition detecting module for detecting an operating condition of the internal combustion engine; a target cam phase setting module for setting a target cam phase in accordance with the detected operating condition; and a control module relying on a response specifying control algorithm to determine a control input to the cam phase varying device at a predetermined control period for converging the actual cam phase to the target cam phase, wherein the response specifying control algorithm is configured to model a controlled object which receives the control input to the cam phase varying device and outputs the actual cam phase, the controlled object is represented by a discrete time based model.

This cam phase control apparatus provides the same advantageous effects as described above concerning the cam phase control apparatus according to the first aspect of the invention.

To achieve the above object, according to a third aspect of the present invention, there is provided a cam phase control apparatus for an internal combustion engine for controlling an actual cam phase of at least one of an intake cam and an exhaust cam with respect to a crank shaft.

The cam phase control method according to the third aspect of the present invention is characterized by comprising the steps of changing the actual cam phase; detecting the actual cam phase; detecting an operating condition of the internal combustion engine; setting a target cam phase in accordance with the detected operating condition; and determining a control input at a predetermined control period in accordance with a response specifying control algorithm for converging the actual cam phase to the target cam phase, wherein the response specifying control algorithm is configured to model a controlled object which receives the control input and outputs the actual cam phase, and the controlled object is represented by a discrete time based model.

This cam phase control method provides the same advantageous effects as described above concerning the cam phase control apparatus according to the first aspect of the invention.

To achieve the above object, according to a fourth aspect of the present invention, there is provided an engine control unit including a control program for causing a computer to carry out control of actual cam phase of at least one of an intake cam and an exhaust cam with respect to a crank shaft in an internal combustion engine.

The engine control unit according to the fourth aspect of the present invention is characterized in that the control program causes the computer to change the actual cam phase; detect the actual cam phase; detect an operating condition of the internal combustion engine; set a target cam phase in accordance with the detected operating condition; and determine a control input at a predetermined control period in accordance with a response specifying control algorithm for converging the actual cam phase to the target cam phase, wherein the response specifying control algorithm is configured to model a controlled object which receives the control input and outputs the actual cam phase, and the controlled object is represented by a discrete time based model.

This engine control unit provides the same advantageous effects as described above concerning the cam phase control apparatus according to the first aspect of the invention.

Preferably, the cam phase control apparatus for an internal combustion engine further comprises sampling means for sampling the control input and the actual cam phase at a predetermined sampling period longer than the control period, wherein the discrete time based model comprises the sampled control input, and time series data of the sampled actual cam phase.

As described above, when this type of cam phase control apparatus attempts to improve the controllability for the cam phase varying means which exhibits an intense friction characteristic, the control input must be determined at a short control period than a predetermined period. On the other hand, in order for the actual cam phase to accurately follow the target cam phase which changes at a low rate, the controlled object model must be matched in frequency characteristic with the actually controlled object in a frequency range which includes the power spectrum of the target cam phase or actual cam phase. Thus, according to this preferred embodiment of the cam phase control apparatus for an internal combustion engine, the sampling means samples the control input and the actual cam phase at a predetermined sampling period longer than the control period, wherein the discrete time based model of the controlled object comprises the control input and time series data of the actual cam phase sampled at this sampling period, so that the dynamic characteristic of the controlled object can be appropriately reflected to the discrete time based model in the frequency range in which the power spectrum of the target cam phase exists. As a result, the controllability can be further improved.

Preferably, the cam phase control apparatus for an internal combustion engine further comprises a sampling module for sampling the control input and the actual cam phase at a predetermined sampling period longer than the control period, wherein the discrete time based model comprises the sampled control input, and time series data of the sampled actual cam phase.

This preferred embodiment of the cam phase control apparatus provides the same advantageous effects as provided by the corresponding preferred embodiment of the cam phase control apparatus according to the first aspect of the invention.

Preferably, the cam phase control method for an internal combustion engine further comprises the step of sampling the control input and the actual cam phase at a predetermined sampling period longer than the control period, wherein the discrete time based model comprises the sampled control input, and time series data of the sampled actual cam phase.

This preferred embodiment of the cam phase control method provides the same advantageous effects as provided by the corresponding preferred embodiment of the cam phase control apparatus according to the first aspect of the invention.

Preferably, in the engine control unit, the control program further causes the computer to sample the control input and the actual cam phase at a predetermined sampling period longer than the control period, wherein the discrete time based model comprises the sampled control input, and time series data of the sampled actual cam phase.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the sampling means samples a deviation of the actual cam phase from the target cam phase at the predetermined sampling period, and the control means determines the control input in accordance with a response specifying control algorithm for creating a switching function as a function of time series data of the sampled deviation.

According to this preferred embodiment of the cam phase control apparatus for an internal combustion engine, since the switching function is created as a function of time series data of the sampled deviation of the actual cam phase from the target cam phase, and the sampling period of these time series data is set longer than the control period, a changing amount of the deviation of the actual cam phase to the target cam phase can be appropriately sampled, unlike the conventional cam phase control apparatus which employs a deviation changing rate as a component of a switching function, so that the cam phase control apparatus according to the present invention can more accurately calculate an increase/decrease in the switching function while avoiding the influence of noise to accurately converge the switching function to zero. As a result, when a sliding mode control algorithm is used, for example, as the response specifying control algorithm, a sliding mode can be generated without fail to ensure the robustness and response specifying characteristic which are features of the sliding mode control. For the same reason, when a disturbance such as a counter-force from a cam, for example, is inputted to the controlled object, the sensibility of the switching function to the disturbance can be improved, and the switching function can be calculated as a value which appropriately reflects the influence of the disturbance, so that the control stability can be ensured for the disturbance. In this way, the switching function can be appropriately calculated. From the foregoing, the controllability can be improved over the prior art in a transient state in which the actual cam phase converges to the target cam phase.

Preferably, in the cam phase control apparatus for an internal combustion engine, the sampling module samples a deviation of the actual cam phase from the target cam phase at the predetermined sampling period, and the control module determines the control input in accordance with a response specifying control algorithm for creating a switching function as a function of time series data of the sampled deviation.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the step of sampling includes sampling a deviation of the actual cam phase from the target cam phase at the predetermined sampling period, and the step of controlling includes determining the control input in accordance with a response specifying control algorithm for creating a switching function as a function of time series data of the sampled deviation.

This preferred embodiment of the cam phase control method provides the same advantageous effects as provided by the corresponding preferred embodiment of the cam phase control apparatus according to the first aspect of the invention.

Preferably, in the engine control unit, the control program further causes the computer to sample a deviation of the actual cam phase from the target cam phase at the predetermined sampling period, and determine the control input in accordance with a response specifying control algorithm for creating a switching function as a function of time series data of the sampled deviation.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the response specifying control algorithm is a sliding mode control algorithm.

According to this preferred embodiment of the cam phase control apparatus for an internal combustion engine, when the sliding mode control algorithm is used as the response specifying control algorithm, the resulting cam phase control apparatus excels in the robustness and response specifying characteristic.

Preferably, in the cam phase control apparatus for an internal combustion engine, the response specifying control algorithm is a sliding mode control algorithm.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the response specifying control algorithm is a sliding mode control algorithm.

This preferred embodiment of the cam phase control method provides the same advantageous effects as provided by the corresponding preferred embodiment of the cam phase control apparatus according to the first aspect of the invention.

Preferably, in the engine control unit, the response specifying control algorithm is a sliding mode control algorithm.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the control input comprises a total sum of a plurality of inputs, each of which is determined in accordance with at least one of a value of the switching function and the actual cam phase.

In this type of sliding mode control apparatus, the control input is made up of the total sum of a plurality of inputs which is determined in accordance with the value of the switching function and/or the output of the controlled object (see, for example, Laid-open Japanese Patent Application No. 11-153051). Therefore, according to this preferred embodiment of the cam phase control apparatus for an internal combustion engine, by appropriately setting a plurality of inputs, a state variable of the switching function, i.e., the values of the time series data of the deviation can be carried on a switching hyperplane, thereby converging the deviation to zero. As a result, the actual cam phase can be appropriately converged to the target cam phase.

Preferably, in the cam phase control apparatus for an internal combustion engine, the control input comprises a total sum of a plurality of inputs, each of which is determined in accordance with at least one of a value of the switching function and the actual cam phase.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the control input comprises a total sum of a plurality of inputs, each of which is determined in accordance with at least one of a value of the switching function and the actual cam phase.

This preferred embodiment of the cam phase control method provides the same advantageous effects as provided by the corresponding preferred embodiment of the cam phase control apparatus according to the first aspect of the invention.

Preferably, in the engine control unit, the control input comprises a total sum of a plurality of inputs, each of which is determined in accordance with at least one of a value of the switching function and the actual cam phase.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the plurality of inputs include a reaching law input proportional to the value of the switching function.

It has been theoretically confirmed that in the sliding mode control algorithm, the value of a state variable of the switching function can be rapidly returned onto the switching hyperplane by virtue of the reaching law input proportional to the value of the switching function, included in the control input, even if the state variable of the switching function largely deviates from the switching hyperplane (or a switching line) due to the influence of a large disturbance and the like (see, for example, Laid-open Japanese Patent Application No. 11-153051). Therefore, this preferred embodiment of the cam phase control apparatus for an internal combustion engine can rapidly return the deviation of the actual cam phase from the target cam phase, as a state variable of the switching function, onto the switching hyperplane to rapidly converge the deviation to zero, thereby ensuring the quick responsibility of the control.

Preferably, in the cam phase control apparatus for an internal combustion engine, the plurality of inputs include a reaching law input proportional to the value of the switching function.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the plurality of inputs include a reaching law input proportional to the value of the switching function.

This preferred embodiment of the cam phase control method provides the same advantageous effects as provided by the corresponding preferred embodiment of the cam phase control apparatus according to the first aspect of the invention.

Preferably, in the engine control unit, the plurality of inputs include a reaching law input proportional to the value of the switching function.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the plurality of inputs include a non-linear input which is set inverse in sign to the value of the switching function.

It has been theoretically confirmed that in the sliding mode control algorithm, a state variable of the switching function can be carried on the switching hyperplane by virtue of a non-linear input which is set inverse in sign to the value of the switching function, included in the control inputs, thereby appropriately suppressing a modeling error and the influence of disturbance as well as compensating the controlled object for the non-linear characteristic in accordance thereto (see, for example, Laid-open Japanese Patent Application No. 11-153051). Therefore, this preferred embodiment of the cam phase control apparatus for an internal combustion engine can suppress the modeling error and influence of disturbance as well as compensate the controlled object for the non-linear characteristic in accordance thereto.

Preferably, in the cam phase control apparatus for an internal combustion engine, the plurality of inputs include a non-linear input which is set inverse in sign to the value of the switching function.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the plurality of inputs include a non-linear input which is set inverse in sign to the value of the switching function.

This preferred embodiment of the cam phase control method provides the same advantageous effects as provided by the corresponding preferred embodiment of the cam phase control apparatus according to the first aspect of the invention.

Preferably, in the engine control unit, the plurality of inputs include a non-linear input which is set inverse in sign to the value of the switching function.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the cam phase varying means comprises an electrically driven spool valve including two hydraulic systems for outputting separate oil pressures respectively from an oil pressure source, and a spool valve body movable within a predetermined movable range including a neutral position at which a differential pressure between the oil pressures in the two hydraulic systems is zero, and responsive to the control input for moving the spool valve body within the movable range to change the differential pressure between the oil pressures in the two hydraulic systems; and a cam phase varying mechanism for changing the actual cam phase in accordance with the differential pressure between the oil pressures in the two hydraulic systems outputted from the electrically movable spool valve, wherein the plurality of inputs include a non-linear input which is set inverse in sign to the value of the switching function, and the non-linear input has a gain which is set in accordance with the differential pressure between the oil pressures in the two hydraulic systems.

In this type of electrically driven spool valve, two oil pressures outputted respectively from the two hydraulic systems generally exhibit non-linear characteristics to the position of the spool valve body within the movable range, i.e., a differential pressure between the oil pressures in the two hydraulic systems. As such, the actual cam phase, which is the output of the cam phase varying means, also generally exhibits a non-linear characteristic. On the other hand, according to this preferred embodiment of the cam phase control apparatus for an internal combustion engine, since the gain of the non-linear input is set in accordance with the pressure difference between the oil pressures in the two hydraulic systems, the cam phase varying means can be appropriately compensated for the non-linear output characteristic in accordance therewith.

Preferably, in the cam phase control apparatus for an internal combustion engine, the cam phase varying device comprises an electrically driven spool valve including two hydraulic systems for outputting separate oil pressures respectively from an oil pressure source, and a spool valve body movable within a predetermined movable range including a neutral position at which a differential pressure between the oil pressures in the two hydraulic systems is zero, and responsive to the control input for moving the spool valve body within the movable range to change the differential pressure between the oil pressures in the two hydraulic systems; and a cam phase varying mechanism for changing the actual cam phase in accordance with the differential pressure between the oil pressures in the two hydraulic systems outputted from the electrically movable spool valve, wherein the plurality of inputs include a non-linear input which is set inverse in sign to the value of the switching function, and the non-linear input has a gain which is set in accordance with the differential pressure between the oil pressures in the two hydraulic systems.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the step of changing the actual cam phase includes changing a differential pressure between oil pressures in two hydraulic systems from an oil pressure source in response to the control input; and changing the actual cam phase in accordance with the differential pressure between the oil pressures in the two hydraulic systems, wherein the plurality of inputs include a non-linear input which is set inverse in sign to the value of the switching function, and the non-linear input has a gain which is set in accordance with the differential pressure between the oil pressures in the two hydraulic systems.

This preferred embodiment of the cam phase control method provides the same advantageous effects as provided by the corresponding preferred embodiment of the cam phase control apparatus according to the first aspect of the invention.

Preferably, in the engine control unit, the control program further causes the computer to change a differential pressure between oil pressures in two hydraulic systems from an oil pressure source in response to the control input; and change the actual cam phase in accordance with the differential pressure between the oil pressures in the two hydraulic systems, wherein the plurality of inputs include a non-linear input which is set inverse in sign to the value of the switching function, and the non-linear input has a gain which is set in accordance with the differential pressure between the oil pressures in the two hydraulic systems.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the gain of the non-linear input is set to a larger value when the differential pressure between the oil pressures in the two hydraulic systems is within a predetermined range including zero than when the differential pressure is not within the predetermined range.

Generally, this type of electrically driven spool valve is most instable in behavior when the spool valve body is near the neutral position, i.e., when the differential pressure between the oil pressures in the two hydraulic systems is near zero, due to the most prominent non-linear characteristic. On the other hand, according to this preferred embodiment of the cam phase control apparatus for an internal combustion engine, since the gain of the non-linear input is set to a larger value when the differential pressure between the oil pressures in the two hydraulic systems is within a predetermined range including zero than when not within the predetermined range, the gain of the non-linear input can be set larger when the non-linear characteristic becomes most prominent by appropriately setting this predetermined range. Consequently, the electrically driven spool valve can be more effectively and appropriately compensated for the non-linear characteristic.

Preferably, in the cam phase control apparatus for an internal combustion engine, the gain of the non-linear input is set to a larger value when the differential pressure between the oil pressures in the two hydraulic systems is within a predetermined range including zero than when the differential pressure is not within the predetermined range.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the gain of the non-linear input is set to a larger value when the differential pressure between the oil pressures in the two hydraulic systems is within a predetermined range including zero than when the differential pressure is not within the predetermined range.

This preferred embodiment of the cam phase control method provides the same advantageous effects as provided by the corresponding preferred embodiment of the cam phase control apparatus according to the first aspect of the invention.

Preferably, in the engine control unit, the gain of the non-linear input is set to a larger value when the differential pressure between the oil pressures in the two hydraulic systems is within a predetermined range including zero than when the differential pressure is not within the predetermined range.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the plurality of inputs include a damping input which is proportional to a rate at which the actual cam phase is changed.

Generally, in the cam phase varying device, the actual cam phase is more likely to overshoot the target cam phase due to the inertia of mechanical parts when the target cam phase is changing at a high rate. On the other hand, according to this preferred embodiment of the cam phase control apparatus for an internal combustion engine, since the control inputs include the damping input which is proportional to the rate at which the actual cam phase changes, the actual cam phase can be appropriately prevented from overshooting the target cam phase in accordance with the changing rate. Particularly, when the actual cam phase is more susceptible to the overshooting due to the inertia of the hydraulic systems and the compressivity of the oil resulting from the hydraulically driven cam phase varying device, the actual cam phase can be effectively prevented from overshooting the target cam phase.

Preferably, in the cam phase control apparatus for an internal combustion engine, the plurality of inputs include a damping input which is proportional to a rate at which the actual cam phase is changed.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the plurality of inputs include a damping input which is proportional to a rate at which the actual cam phase is changed.

This preferred embodiment of the cam phase control method provides the same advantageous effects as provided by the corresponding preferred embodiment of the cam phase control apparatus according to the first aspect of the invention.

Preferably, in the engine control unit, the plurality of inputs include a damping input which is proportional to a rate at which the actual cam phase is changed.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the plurality of inputs include an adaptive law input which is proportional to an integrated value of the switching function.

In a so-called adaptive sliding mode control algorithm in which the control inputs include an adaptive law input which is proportional to an integrated value of the switching function, it is theoretically confirmed that the adaptive law input can help carry the value of a state variable of the switching function on the switching hyperplane without fail, while suppressing a steady-state deviation of the controlled object, a modeling error, and the influence of disturbance (see, for example, Laid-open Japanese Patent Application No. 11-153051). Therefore, this preferred embodiment of the cam phase control apparatus for an internal combustion engine can carry the time series data of the deviation of the actual cam phase from the target cam phase on the switching hyperplane, while suppressing the steady-state deviation of the controlled object, modeling error, and influence of disturbance, thereby converging the deviation to zero without fail. In other words, the cam phase control apparatus for an internal combustion engine can ensure the stability of the control against the steady-state deviation of the controlled object, modeling error, and influence of disturbance.

Preferably, in the cam phase control apparatus for an internal combustion engine, the plurality of inputs include an adaptive law input which is proportional to an integrated value of the switching function.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the plurality of inputs include an adaptive law input which is proportional to an integrated value of the switching function.

This preferred embodiment of the cam phase control method provides the same advantageous effects as provided by the corresponding preferred embodiment of the cam phase control apparatus according to the first aspect of the invention.

Preferably, in the engine control unit, the plurality of inputs include an adaptive law input which is proportional to an integrated value of the switching function.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the adaptive law input has a gain which is set in accordance with the value of the switching function.

According to this preferred embodiment of the cam phase control apparatus for an internal combustion engine, since the gain of the adaptive law input is set in accordance with the value of the switching function, it is possible to appropriately prevent the actual cam phase from overshooting the target cam phase, due to the integration characteristic of the adaptive law input.

Preferably, in the cam phase control apparatus for an internal combustion engine, the adaptive law input has a gain which is set in accordance with the value of the switching function.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the adaptive law input has a gain which is set in accordance with the value of the switching function.

This preferred embodiment of the cam phase control method provides the same advantageous effects as provided by the corresponding preferred embodiment of the cam phase control apparatus according to the first aspect of the invention.

Preferably, in the engine control unit, the adaptive law input has a gain which is set in accordance with the value of the switching function.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the plurality of inputs include an equivalent control input which is determined based on a plurality of values of actual cam phases sequentially sampled at the predetermined sampling period.

It has been theoretically confirmed that in the sliding mode control algorithm, an equivalent control input included in the control inputs can help securely restrict a state variable of the switching function on the switching hyperplane (see, for example, Laid-open Japanese Patent Application No. 11-153051). Therefore, according to this preferred embodiment of the cam phase control apparatus for an internal combustion engine, the time series data of the deviation as a state variable of the switching function can be securely restricted on the switching hyperplane, thereby converging the actual cam phase to the target cam phase without fail (i.e., converging the deviation to zero), and maintaining a stable behavior of the actual cam phase after the convergence. In addition, when the sampling period of the actual cam phase is set longer than the control period in the aforementioned preferred embodiment, the dynamic characteristic of the actual cam phase can be appropriately reflected to the equivalent control input near the frequency range in which the power spectrum of the target cam phase exists by appropriately setting the sampling period of the actual cam phase in accordance with the frequency range, even when the cam phase varying device exhibits an intense friction characteristic. Consequently, the stability can be ensured in controlling the actual cam phase near the frequency range in which the power spectrum of the target cam phase exists.

Preferably, in the cam phase control apparatus for an internal combustion engine, the plurality of inputs include an equivalent control input which is determined based on a plurality of values of actual cam phases sequentially sampled at the predetermined sampling period.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the plurality of inputs include an equivalent control input which is determined based on a plurality of values of actual cam phases sequentially sampled at the predetermined sampling period.

This preferred embodiment of the cam phase control method provides the same advantageous effects as provided by the corresponding preferred embodiment of the cam phase control apparatus according to the first aspect of the invention.

Preferably, in the engine control unit, the plurality of inputs include an equivalent control input which is determined based on a plurality of values of actual cam phases sequentially sampled at the predetermined sampling period.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the plurality of inputs include at least one input which has a gain scheduled in different manners from each other when the actual cam phase is advanced and when the actual cam phase is retarded.

According to this preferred embodiment of the cam phase control apparatus for an internal combustion engine, even if the actual cam phase responses to the control input in different manners when it is advanced and when it is retarded, the actual cam phase can be compensated for the responsibility such that the same responsibility is provided when the actual cam phase is advanced or retarded.

Preferably, in the cam phase control apparatus for an internal combustion engine, the plurality of inputs include at least one input which has a gain scheduled in different manners from each other when the actual cam phase is advanced and when the actual cam phase is retarded.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the plurality of inputs include at least one input which has a gain scheduled in different manners from each other when the actual cam phase is advanced and when the actual cam phase is retarded.

This preferred embodiment of the cam phase control method provides the same advantageous effects as provided by the corresponding preferred embodiment of the cam phase control apparatus according to the first aspect of the invention.

Preferably, in the engine control unit, the plurality of inputs include at least one input which has a gain scheduled in different manners from each other when the actual cam phase is advanced and when the actual cam phase is retarded.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the cam phase varying means is configured to change the actual cam phase with an oil pressure supplied from an oil pressure source, at least one of the time series data of the deviation making up the switching function is multiplied by a multiplication coefficient, and the multiplication coefficient is set in accordance with the oil pressure supplied from the oil pressure source to the cam phase varying means.

Generally, this type of cam phase varying means presents a change in the dynamic characteristic thereof (dynamic characteristic of the actual cam phase), more specifically, its response characteristic as it is supplied with a varying oil pressure from the oil pressure source. On the other hand, according to this preferred embodiment of the cam phase control apparatus for an internal combustion engine, at least one of the time series data of the deviation, which make up the switching function, is multiplied by the multiplication coefficient set in accordance with the oil pressure supplied from the oil pressure source to appropriately set a rate at which the actual cam phase follows the target cam phase in accordance with the response characteristic of the cam phase varying device, so that the cam phase varying means can appropriately change the actual cam phase while compensating for a change in the response characteristic resulting from a change in the oil pressure, thereby maintaining a stable responsibility of the actual cam phase to the control input. As a result, the internal combustion engine can be maintained in a stable operating condition.

Preferably, in the cam phase control apparatus for an internal combustion engine, the cam phase varying device is configured to change the actual cam phase with an oil pressure supplied from an oil pressure source, at least one of the time series data of the deviation making up the switching function is multiplied by a multiplication coefficient, and the multiplication coefficient is set in accordance with the oil pressure supplied from the oil pressure source to the cam phase varying device.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the step of changing the actual cam phase includes changing the actual cam phase with an oil pressure supplied from an oil pressure source, wherein at least one of the time series data of the deviation making up the switching function is multiplied by a multiplication coefficient, and the multiplication coefficient is set in accordance with the oil pressure supplied from the oil pressure source.

This preferred embodiment of the cam phase control method provides the same advantageous effects as provided by the corresponding preferred embodiment of the cam phase control apparatus according to the first aspect of the invention.

Preferably, in the engine control unit, the control program further causes the computer to change the actual cam phase with an oil pressure supplied from an oil pressure source, multiply at least one of the time series data of the deviation making up the switching function by a multiplication coefficient, and set the multiplication coefficient in accordance with the oil pressure supplied from the oil pressure source.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the multiplication coefficient is set such that the deviation decreases at a lower rate as a differential pressure between the oil pressure and a predetermined reference pressure is larger.

In this type of cam phase varying means, it has been confirmed that the actual cam phase optimally converges to the target cam phase when the oil pressure supplied from the oil pressure source is at a predetermined pressure; more susceptible to overshoot the target cam phase as the oil pressure is higher than the predetermined pressure; and more slowly converges to the target cam phase as the oil pressure is lower than the predetermined pressure (see FIG. 6). Therefore, according to this preferred embodiment of the cam phase control apparatus for an internal combustion engine, with the predetermined reference pressure set as the predetermined pressure as mentioned above, the deviation decreases at a lower rate when the oil pressure is higher than the predetermined reference pressure to prevent the actual cam phase from overshooting the target cam phase, whereas the deviation decreases at a higher rate when the oil pressure is lower than the predetermined reference pressure to appropriately increase the rate at which the actual cam phase converges to the target cam phase.

Preferably, in the cam phase control apparatus for an internal combustion engine, the multiplication coefficient is set such that the deviation decreases at a lower rate as a differential pressure between the oil pressure and a predetermined reference pressure is larger.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the multiplication coefficient is set such that the deviation decreases at a lower rate as a differential pressure between the oil pressure and a predetermined reference pressure is larger.

This preferred embodiment of the cam phase control method provides the same advantageous effects as provided by the corresponding preferred embodiment of the cam phase control apparatus according to the first aspect of the invention.

Preferably, in the engine control unit, the multiplication coefficient is set such that the deviation decreases at a lower rate as a differential pressure between the oil pressure and a predetermined reference pressure is larger.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the oil pressure source supplies the cam phase varying means with an oil used in the internal combustion engine, and the multiplication coefficient is set such that the deviation decreases at a lower rate as a shorter time has elapsed from a start of the internal combustion engine.

Generally, in this type of cam phase varying device, the actual cam phase changes more slowly, as the temperature of the oil supplied from the oil pressure source is lower, due to a larger viscous resistance of the oil. Consequently, a degraded responsibility causes an instable behavior of the actual cam phase. For this reason, a low oil temperature may cause an instable behavior of the actual cam phase immediately after the internal combustion engine is started. On the other hand, according to this preferred embodiment of the cam phase control apparatus for an internal combustion engine, since the rate at which the deviation decreases is set lower as a shorter time has elapsed from the start of the internal combustion engine, the responsibility of the control is made lower as the temperature of the oil is lower to make the actual cam phase more susceptible to an instable behavior, thereby making it possible to appropriately converge the actual cam phase to the target cam phase, while compensating the actual cam phase for an instable condition immediately after the start of the internal combustion engine, to ensure the stability for the control.

Preferably, in the cam phase control apparatus for an internal combustion engine, the oil pressure source supplies the cam phase varying device with an oil used in the internal combustion engine, and the multiplication coefficient is set such that the deviation decreases at a lower rate as a shorter time has elapsed from a start of the internal combustion engine.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the oil pressure source supplies an oil used in the internal combustion engine, and the multiplication coefficient is set such that the deviation decreases at a lower rate as a shorter time has elapsed from a start of the internal combustion engine.

This preferred embodiment of the cam phase control method provides the same advantageous effects as provided by the corresponding preferred embodiment of the cam phase control apparatus according to the first aspect of the invention.

Preferably, in the engine control unit, the oil pressure source supplies an oil used in the internal combustion engine, and the multiplication coefficient is set such that the deviation decreases at a lower rate as a shorter time has elapsed from a start of the internal combustion engine.

This preferred embodiment of the engine control unit provides the same advantageous effects as provided by the corresponding preferred embodiment of the cam phase control apparatus according to the first aspect of the invention.

Preferably, in the cam phase control apparatus for an internal combustion engine, the cam phase varying means is configured to change the actual cam phase with an oil supplied from an oil pressure source for use by the internal combustion engine, at least one of the time series data of the deviation making up the switching function is multiplied by a multiplication coefficient, and the multiplication coefficient is set such that the deviation decreases at a lower rate as a shorter time has elapsed from a start of the internal combustion engine.

According to this preferred embodiment of the cam phase control apparatus for an internal combustion engine, since the rate at which the deviation decreases is set lower as a shorter time has elapsed from the start of the internal combustion engine, the responsibility of the control is made lower as the temperature of the oil is lower to make the actual cam phase more susceptible to an instable behavior, thereby making it possible to appropriately converge the actual cam phase to the target cam phase, while compensating the actual cam phase for an instable condition immediately after the start of the internal combustion engine, to ensure the stability for the control.

Preferably, in the cam phase control apparatus for an internal combustion engine, the cam phase varying device is configured to change the actual cam phase with an oil supplied from an oil pressure source for use by the internal combustion engine, at least one of the time series data of the deviation making up the switching function is multiplied by a multiplication coefficient, and the multiplication coefficient is set such that the deviation decreases at a lower rate as a shorter time has elapsed from a start of the internal combustion engine.

This preferred embodiment of the cam phase control apparatus provides the same advantageous effects as provided by the corresponding preferred embodiment of the cam phase control apparatus according to the first aspect of the invention.

Preferably, in the cam phase control method for an internal combustion engine, the step of changing the actual cam phase includes changing the actual cam phase with an oil supplied from an oil pressure source for use by the internal combustion engine, wherein at least one of the time series data of the deviation making up the switching function is multiplied by a multiplication coefficient, and the multiplication coefficient is set such that the deviation decreases at a lower rate as a shorter time has elapsed from a start of the internal combustion engine.

This preferred embodiment of the cam phase control method provides the same advantageous effects as provided by the corresponding preferred embodiment of the cam phase control apparatus according to the first aspect of the invention.

Preferably, in the engine control unit, the control program further causes the computer to change the actual cam phase with an oil supplied from an oil pressure source for use by the internal combustion engine, multiply at least one of the time series data of the deviation making up the switching function by a multiplication coefficient, and set the multiplication coefficient such that the deviation decreases at a lower rate as a shorter time has elapsed from a start of the internal combustion engine.

This preferred embodiment of the engine control unit provides the same advantageous effects as provided by the corresponding preferred embodiment of the cam phase control apparatus according to the first aspect of the invention.

To achieve the above object, according to a fifth aspect of the present invention, there is provided a cam phase control apparatus for an internal combustion engine for controlling an actual cam phase of at least one of an intake cam and an exhaust cam with respect to a crank shaft.

The cam phase control apparatus for an internal combustion engine according to the fifth aspect of the invention is characterized by comprising cam phase varying means for changing the actual cam phase; cam phase detecting means for detecting the actual cam phase; operating condition detecting means for detecting an operating condition of the internal combustion engine; target cam phase setting means for setting a target cam phase in accordance with the detected operating condition; sampling means for sampling a deviation of the detected actual cam phase from the set target cam phase at a predetermined sampling period; and control means relying on a response specifying control algorithm for creating a switching function as a function of time series data of the sampled deviation to determine a control input to the cam phase varying means at a predetermined control period for converging the actual cam phase to the target cam phase.

According to this cam phase control apparatus for an internal combustion engine, since the switching function is set as a function of time series data of the deviation of the actual cam phase from the target cam phase, sampled at the predetermined sampling period, the deviation of the actual cam phase from the target cam phase can be sampled as a value to which an increase/decrease behavior of the deviation is appropriately reflected in the frequency range in which the power spectrum of the target cam phase exists by appropriately setting the sampling period of the time series data. Thus, unlike the conventional cam phase control apparatus which employs a deviation changing rate as a component of a switching function, the switching function can be appropriately calculated while avoiding the influence of noise even when the cam phase varying device exhibits, for example, an intense friction characteristic, and the control input is calculated at a control period shorter than a period which corresponds to the frequency range in which the power spectrum of the target cam phase exists, thereby increasing the responsibility in a transient state in which the actual cam phase converges to the target cam phase.

To achieve the above object, according to a sixth aspect of the present invention, there is provided a cam phase control apparatus for an internal combustion engine for controlling an actual cam phase of at least one of an intake cam and an exhaust cam with respect to a crank shaft.

The cam phase control apparatus for an internal combustion engine according to the sixth aspect of the invention is characterized by comprising a cam phase varying device for changing the actual cam phase; a cam phase detecting module for detecting the actual cam phase; an operating condition detecting module for detecting an operating condition of the internal combustion engine; a target cam phase setting module for setting a target cam phase in accordance with the detected operating condition; a sampling module for sampling a deviation of the detected actual cam phase from the set target cam phase at a predetermined sampling period; and a control module relying on a response specifying control algorithm for creating a switching function as a function of time series data of the sampled deviation to determine a control input to the cam phase varying device at a predetermined control period for converging the actual cam phase to the target cam phase.

This cam phase control apparatus provides the same advantageous effects as described above concerning the cam phase control apparatus according to the fifth aspect of the invention.

To achieve the above object, according to a seventh aspect of the present invention, there is provided a cam phase control apparatus for an internal combustion engine for controlling an actual cam phase of at least one of an intake cam and an exhaust cam with respect to a crank shaft.

The cam phase control method according to the seventh aspect of the present invention is characterized by comprising the steps of changing the actual cam phase; detecting the actual cam phase; detecting an operating condition of the internal combustion engine; setting a target cam phase in accordance with the detected operating condition; sampling a deviation of the detected actual cam phase from the set target cam phase at a predetermined sampling period; and determining a control input at a predetermined control period in accordance with a response specifying control algorithm for creating a switching function as a function of time series data of the sampled deviation for converging the actual cam phase to the target cam phase.

This cam phase control method provides the same advantageous effects as described above concerning the cam phase control apparatus according to the fifth aspect of the invention.

To achieve the above object, according to an eighth aspect of the present invention, there is provided an engine control unit including a control program for causing a computer to carry out control of actual cam phase of at least one of an intake cam and an exhaust cam with respect to a crank shaft in an internal combustion engine.

The engine control unit according to the eighth aspect of the present invention is characterized in that the control program causes the computer to change the actual cam phase; detect the actual cam phase; detect an operating condition of the internal combustion engine; set a target cam phase in accordance with the detected operating condition; sample a deviation of the detected actual cam phase from the set target cam phase at a predetermined sampling period; and determine a control input at a predetermined control period in accordance with a response specifying control algorithm for creating a switching function as a function of time series data of the sampled deviation for converging the actual cam phase to the target cam phase.

This cam phase control apparatus provides the same advantageous effects as described above concerning the cam phase control apparatus according to the fifth aspect of the invention.

Preferably, in the cam phase control apparatus for an internal combustion engine, the predetermined sampling period is set longer than the control period.

According to this preferred embodiment of the cam phase control apparatus for an internal combustion engine, since the switching function is created as a function of time series data of the sampled deviation of the actual cam phase from the target cam phase, and the sampling period of these time series data is set longer than the control period, a changing amount of the deviation of the actual cam phase to the target cam phase can be appropriately sampled, unlike the conventional cam phase control apparatus which employs a deviation changing rate as a component of a switching function, so that the cam phase control apparatus according to the present invention can more accurately calculate an increase/decrease in the switching function while avoiding the influence of noise to accurately converge the switching function to zero. As a result, when a sliding mode control algorithm is used, for example, as the response specifying control algorithm, a sliding mode can be generated without fail to ensure the robustness and response specifying characteristic which are features of the sliding mode control. For the same reason, when a disturbance such as a counter-force from a cam, for example, is inputted to the controlled object, the sensibility of the switching function to the disturbance can be improved, and the switching function can be calculated as a value which appropriately reflects the influence of the disturbance, so that the control stability can be ensured for the disturbance. In this way, the switching function can be appropriately calculated. From the foregoing, the controllability can be improved over the prior art in a transient state in which the actual cam phase converges to the target cam phase.

Preferably, in the cam phase control apparatus for an internal combustion engine, the predetermined sampling period is set longer than the control period.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the predetermined sampling period is set longer than the control period.

This preferred embodiment of the cam phase control method provides the same advantageous effects as provided by the corresponding preferred embodiment of the cam phase control apparatus according to the fifth aspect of the invention.

Preferably, in the engine control unit, the predetermined sampling period is set longer than the control period.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the response specifying control algorithm is a sliding mode control algorithm.

According to this preferred embodiment of the cam phase control apparatus for an internal combustion engine, when the sliding mode control algorithm is used as the response specifying control algorithm, the resulting cam phase control apparatus excels in the robustness and response specifying characteristic.

Preferably, in the cam phase control apparatus for an internal combustion engine, the response specifying control algorithm is a sliding mode control algorithm.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the response specifying control algorithm is a sliding mode control algorithm.

This preferred embodiment of the cam phase control method provides the same advantageous effects as provided by the corresponding preferred embodiment of the cam phase control apparatus according to the fifth aspect of the invention.

Preferably, in the engine control unit, the response specifying control algorithm is a sliding mode control algorithm.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the control input comprises a total sum of a plurality of inputs, each of which is determined in accordance with at least one of a value of the switching function and the actual cam phase.

In this type of sliding mode control apparatus, the control input is made up of the total sum of a plurality of inputs which is determined in accordance with the value of the switching function and/or the output of the controlled object (see, for example, Laid-open Japanese Patent Application No. 11-153051). Therefore, according to this preferred embodiment of the cam phase control apparatus for an internal combustion engine, by appropriately setting a plurality of inputs, a state variable of the switching function, i.e., the values of the time series data of the deviation can be carried on a switching hyperplane, thereby converging the deviation to zero. As a result, the actual cam phase can be appropriately converged to the target cam phase.

Preferably, in the cam phase control apparatus for an internal combustion engine, the control input comprises a total sum of a plurality of inputs, each of which is determined in accordance with at least one of a value of the switching function and the actual cam phase.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the control input comprises a total sum of a plurality of inputs, each of which is determined in accordance with at least one of a value of the switching function and the actual cam phase.

This preferred embodiment of the cam phase control method provides the same advantageous effects as provided by the corresponding preferred embodiment of the cam phase control apparatus according to the fifth aspect of the invention.

Preferably, in the engine control unit, the control input comprises a total sum of a plurality of inputs, each of which is determined in accordance with at least one of a value of the switching function and the actual cam phase.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the plurality of inputs include a reaching law input proportional to the value of the switching function.

It has been theoretically confirmed that in the sliding mode control algorithm, the value of a state variable of the switching function can be rapidly returned onto the switching hyperplane by virtue of the reaching law input proportional to the value of the switching function, included in the control input, even if the state variable of the switching function largely deviates from the switching hyperplane (or a switching line) due to the influence of a large disturbance and the like (see, for example, Laid-open Japanese Patent Application No. 11-153051). Therefore, this preferred embodiment of the cam phase control apparatus for an internal combustion engine can rapidly return the deviation of the actual cam phase from the target cam phase, as a state variable of the switching function, onto the switching hyperplane to rapidly converge the deviation to zero, thereby ensuring the quick responsibility of the control.

Preferably, in the cam phase control apparatus for an internal combustion engine, the plurality of inputs include a reaching law input proportional to the value of the switching function.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the plurality of inputs include a reaching law input proportional to the value of the switching function.

This preferred embodiment of the cam phase control method provides the same advantageous effects as provided by the corresponding preferred embodiment of the cam phase control apparatus according to the fifth aspect of the invention.

Preferably, in the engine control unit, the plurality of inputs include a reaching law input proportional to the value of the switching function.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the plurality of inputs include a non-linear input which is set inverse in sign to the value of the switching function.

It has been theoretically confirmed that in the sliding mode control algorithm, a state variable of the switching function can be carried on the switching hyperplane by virtue of a non-linear input which is set inverse in sign to the value of the switching function, included in the control inputs, thereby appropriately suppressing a modeling error and the influence of disturbance as well as compensating the controlled object for the non-linear characteristic in accordance thereto (see, for example, Laid-open Japanese Patent Application No. 11-153051). Therefore, this preferred embodiment of the cam phase control apparatus for an internal combustion engine can suppress the modeling error and influence of disturbance as well as compensate the controlled object for the non-linear characteristic in accordance thereto.

Preferably, in the cam phase control apparatus for an internal combustion engine, the plurality of inputs include a non-linear input which is set inverse in sign to the value of the switching function.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the plurality of inputs include a non-linear input which is set inverse in sign to the value of the switching function.

This preferred embodiment of the cam phase control method provides the same advantageous effects as provided by the corresponding preferred embodiment of the cam phase control apparatus according to the fifth aspect of the invention.

Preferably, in the engine control unit, the plurality of inputs include a non-linear input which is set inverse in sign to the value of the switching function.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the cam phase varying means comprises an electrically driven spool valve including two hydraulic systems for outputting separate oil pressures respectively from an oil pressure source, and a spool valve body movable within a predetermined movable range including a neutral position at which a differential pressure between the oil pressures in the two hydraulic systems is zero, and responsive to the control input for moving the spool valve body within the movable range to change the differential pressure between the oil pressures in the two hydraulic systems; and a cam phase varying mechanism for changing the actual cam phase in accordance with the differential pressure between the oil pressures in the two hydraulic systems outputted from the electrically movable spool valve, wherein the plurality of inputs include a non-linear input which is set inverse in sign to the value of the switching function, and the non-linear input has a gain which is set in accordance with the differential pressure between the oil pressures in the two hydraulic systems.

In this type of electrically driven spool valve, two oil pressures outputted respectively from the two hydraulic systems generally exhibit non-linear characteristics to the position of the spool valve body within the movable range, i.e., a differential pressure between the oil pressures in the two hydraulic systems. As such, the actual cam phase, which is the output of the cam phase varying means, also generally exhibits a non-linear characteristic. On the other hand, according to this preferred embodiment of the cam phase control apparatus for an internal combustion engine, since the gain of the non-linear input is set in accordance with the pressure difference between the oil pressures in the two hydraulic systems, the cam phase varying means can be appropriately compensated for the non-linear output characteristic in accordance therewith.

Preferably, in the cam phase control apparatus for an internal combustion engine, the cam phase varying device comprises an electrically driven spool valve including two hydraulic systems for outputting separate oil pressures respectively from an oil pressure source, and a spool valve body movable within a predetermined movable range including a neutral position at which a differential pressure between the oil pressures in the two hydraulic systems is zero, and responsive to the control input for moving the spool valve body within the movable range to change the differential pressure between the oil pressures in the two hydraulic systems; and a cam phase varying mechanism for changing the actual cam phase in accordance with the differential pressure between the oil pressures in the two hydraulic systems outputted from the electrically movable spool valve, wherein the plurality of inputs include a non-linear input which is set inverse in sign to the value of the switching function, the non-linear input having a gain which is set in accordance with the differential pressure between the oil pressures in the two hydraulic systems.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the step of changing the actual cam phase includes changing a differential pressure between oil pressures in two hydraulic systems from an oil pressure source in response to the control input; and changing the actual cam phase in accordance with the differential pressure between the oil pressures in the two hydraulic systems, wherein the plurality of inputs include a non-linear input which is set inverse in sign to the value of the switching function, the non-linear input having a gain which is set in accordance with the differential pressure between the oil pressures in the two hydraulic systems.

This preferred embodiment of the cam phase control method provides the same advantageous effects as provided by the corresponding preferred embodiment of the cam phase control apparatus according to the fifth aspect of the invention.

Preferably, in the engine control unit, the control program further causes the computer to change a differential pressure between oil pressures in two hydraulic systems from an oil pressure source in response to the control input; and change the actual cam phase in accordance with the differential pressure between the oil pressures in the two hydraulic systems, wherein the plurality of inputs include a non-linear input which is set inverse in sign to the value of the switching function, the non-linear input having a gain which is set in accordance with the differential pressure between the oil pressures in the two hydraulic systems.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the gain of the non-linear input is set to a larger value when the differential pressure between the oil pressures in the two hydraulic systems is within a predetermined range including zero than when the differential pressure is not within the predetermined range.

Generally, this type of electrically driven spool valve is most instable in behavior when the spool valve body is near the neutral position, i.e., when the differential pressure between the oil pressures in the two hydraulic systems is near zero, due to the most prominent non-linear characteristic. On the other hand, according to this preferred embodiment of the cam phase control apparatus for an internal combustion engine, since the gain of the non-linear input is set to a larger value when the differential pressure between the oil pressures in the two hydraulic systems is within a predetermined range including zero than when not within the predetermined range, the gain of the non-linear input can be set larger when the non-linear characteristic becomes most prominent by appropriately setting this predetermined range. Consequently, the electrically driven spool valve can be more effectively and appropriately compensated for the non-linear characteristic.

Preferably, in the cam phase control apparatus for an internal combustion engine, the gain of the non-linear input is set to a larger value when the differential pressure between the oil pressures in the two hydraulic systems is within a predetermined range including zero than when the differential pressure is not within the predetermined range.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the gain of the non-linear input is set to a larger value when the differential pressure between the oil pressures in the two hydraulic systems is within a predetermined range including zero than when the differential pressure is not within the predetermined range.

This preferred embodiment of the cam phase control method provides the same advantageous effects as provided by the corresponding preferred embodiment of the cam phase control apparatus according to the fifth aspect of the invention.

Preferably, in the engine control unit, the gain of the non-linear input is set to a larger value when the differential pressure between the oil pressures in the two hydraulic systems is within a predetermined range including zero than when the differential pressure is not within the predetermined range.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the plurality of inputs include a damping input which is proportional to a rate at which the actual cam phase is changed.

Generally, in the cam phase varying device, the actual cam phase is more likely to overshoot the target cam phase due to the inertia of mechanical parts when the target cam phase is changing at a high rate. On the other hand, according to this preferred embodiment of the cam phase control apparatus for an internal combustion engine, since the control inputs include the damping input which is proportional to the rate at which the actual cam phase changes, the actual cam phase can be appropriately prevented from overshooting the target cam phase in accordance with the changing rate. Particularly, when the actual cam phase is more susceptible to the overshooting due to the inertia of the hydraulic systems and the compressivity of the oil resulting from the hydraulically driven cam phase varying device, the actual cam phase can be effectively prevented from overshooting the target cam phase.

Preferably, in the cam phase control apparatus for an internal combustion engine, the plurality of inputs include a damping input which is proportional to a rate at which the actual cam phase is changed.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the plurality of inputs include a damping input which is proportional to a rate at which the actual cam phase is changed.

This preferred embodiment of the cam phase control method provides the same advantageous effects as provided by the corresponding preferred embodiment of the cam phase control apparatus according to the fifth aspect of the invention.

Preferably, in the engine control unit, the plurality of inputs include a damping input which is proportional to a rate at which the actual cam phase is changed.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the plurality of inputs include an adaptive law input which is proportional to an integrated value of the switching function.

In a so-called adaptive sliding mode control algorithm in which the control inputs include an adaptive law input which is proportional to an integrated value of the switching function, it is theoretically confirmed that the adaptive law input can help carry the value of a state variable of the switching function on the switching hyperplane without fail, while suppressing a steady-state deviation of the controlled object, a modeling error, and the influence of disturbance (see, for example, Laid-open Japanese Patent Application No. 11-153051). Therefore, this preferred embodiment of the cam phase control apparatus for an internal combustion engine can carry the time series data of the deviation of the actual cam phase from the target cam phase on the switching hyperplane, while suppressing the steady-state deviation of the controlled object, modeling error, and influence of disturbance, thereby converging the deviation to zero without fail. In other words, the cam phase control apparatus for an internal combustion engine can ensure the stability of the control against the steady-state deviation of the controlled object, modeling error, and influence of disturbance.

Preferably, in the cam phase control apparatus for an internal combustion engine, the plurality of inputs include an adaptive law input which is proportional to an integrated value of the switching function.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the plurality of inputs include an adaptive law input which is proportional to an integrated value of the switching function.

This preferred embodiment of the cam phase control method provides the same advantageous effects as provided by the corresponding preferred embodiment of the cam phase control apparatus according to the fifth aspect of the invention.

Preferably, in the engine control unit, the plurality of inputs include an adaptive law input which is proportional to an integrated value of the switching function.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the adaptive law input has a gain which is set in accordance with the value of the switching function.

According to this preferred embodiment of the cam phase control apparatus for an internal combustion engine, since the gain of the adaptive law input is set in accordance with the value of the switching function, it is possible to appropriately prevent the actual cam phase from overshooting the target cam phase, due to the integration characteristic of the adaptive law input.

Preferably, in the cam phase control apparatus for an internal combustion engine, the adaptive law input has a gain which is set in accordance with the value of the switching function.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the adaptive law input has a gain which is set in accordance with the value of the switching function.

This preferred embodiment of the cam phase control method provides the same advantageous effects as provided by the corresponding preferred embodiment of the cam phase control apparatus according to the fifth aspect of the invention.

Preferably, in the engine control unit, the adaptive law input has a gain which is set in accordance with the value of the switching function.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the sampling means further samples the actual cam phase at the predetermined sampling period, and the plurality of inputs include an equivalent control input which is determined based on a plurality of values of actual cam phases sequentially sampled at the predetermined sampling period.

It has been theoretically confirmed that in the sliding mode control algorithm, an equivalent control input included in the control inputs can help securely restrict a state variable of the switching function on the switching hyperplane (see, for example, Laid-open Japanese Patent Application No. 11-153051). Therefore, according to this preferred embodiment of the cam phase control apparatus for an internal combustion engine, the time series data of the deviation as a state variable of the switching function can be securely restricted on the switching hyperplane, thereby converging the actual cam phase to the target cam phase without fail (i.e., converging the deviation to zero), and maintaining a stable behavior of the actual cam phase after the convergence. In addition, when the sampling period of the actual cam phase is set longer than the control period in the aforementioned preferred embodiment, the dynamic characteristic of the actual cam phase can be appropriately reflected to the equivalent control input near the frequency range in which the power spectrum of the target cam phase exists by appropriately setting the sampling period of the actual cam phase in accordance with the frequency range, even when the cam phase varying device exhibits an intense friction characteristic. Consequently, the stability can be ensured in controlling the actual cam phase near the frequency range in which the power spectrum of the target cam phase exists.

Preferably, in the cam phase control apparatus for an internal combustion engine, the sampling module further samples the actual cam phase at the predetermined sampling period, and the plurality of inputs include an equivalent control input which is determined based on a plurality of values of actual cam phases sequentially sampled at the predetermined sampling period.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the step of sampling further includes sampling the actual cam phase at the predetermined sampling period, and the plurality of inputs include an equivalent control input which is determined based on a plurality of values of actual cam phases sequentially sampled at the predetermined sampling period.

This preferred embodiment of the cam phase control method provides the same advantageous effects as provided by the corresponding preferred embodiment of the cam phase control apparatus according to the fifth aspect of the invention.

Preferably, in the engine control unit, the control program further causes the computer to sample the actual cam phase at the predetermined sampling period, and the plurality of inputs include an equivalent control input which is determined based on a plurality of values of actual cam phases sequentially sampled at the predetermined sampling period.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the plurality of inputs include at least one input which has a gain scheduled in different manners from each other when the actual cam phase is advanced and when the actual cam phase is retarded.

According to this preferred embodiment of the cam phase control apparatus for an internal combustion engine, even if the actual cam phase responses to the control input in different manners when it is advanced and when it is retarded, the actual cam phase can be compensated for the responsibility such that the same responsibility is provided when the actual cam phase is advanced or retarded.

Preferably, in the cam phase control apparatus for an internal combustion engine, the plurality of inputs include at least one input which has a gain scheduled in different manners from each other when the actual cam phase is advanced and when the actual cam phase is retarded.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the plurality of inputs include at least one input which has a gain scheduled in different manners from each other when the actual cam phase is advanced and when the actual cam phase is retarded.

This preferred embodiment of the cam phase control method provides the same advantageous effects as provided by the corresponding preferred embodiment of the cam phase control apparatus according to the fifth aspect of the invention.

Preferably, in the engine control unit, the plurality of inputs include at least one input which has a gain scheduled in different manners from each other when the actual cam phase is advanced and when the actual cam phase is retarded.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the cam phase varying means is configured to change the actual cam phase with an oil pressure supplied from an oil pressure source, at least one of the time series data of the deviation making up the switching function is multiplied by a multiplication coefficient, and the multiplication coefficient is set in accordance with the oil pressure supplied from the oil pressure source to the cam phase varying means.

Generally, this type of cam phase varying means presents a change in the dynamic characteristic thereof (dynamic characteristic of the actual cam phase), more specifically, its response characteristic as it is supplied with a varying oil pressure from the oil pressure source. On the other hand, according to this preferred embodiment of the cam phase control apparatus for an internal combustion engine, at least one of the time series data of the deviation, which make up the switching function, is multiplied by the multiplication coefficient set in accordance with the oil pressure supplied from the oil pressure source to appropriately set a rate at which the actual cam phase follows the target cam phase in accordance with the response characteristic of the cam phase varying device, so that the cam phase varying means can appropriately change the actual cam phase while compensating for a change in the response characteristic resulting from a change in the oil pressure, thereby maintaining a stable responsibility of the actual cam phase to the control input. As a result, the internal combustion engine can be maintained in a stable operating condition.

Preferably, in the cam phase control apparatus for an internal combustion engine, the cam phase varying device is configured to change the actual cam phase with an oil pressure supplied from an oil pressure source, at least one of the time series data of the deviation making up the switching function is multiplied by a multiplication coefficient, and the multiplication coefficient is set in accordance with the oil pressure supplied from the oil pressure source to the cam phase varying device.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the step of changing the actual cam phase includes changing the actual cam phase with an oil pressure supplied from an oil pressure source, wherein at least one of the time series data of the deviation making up the switching function is multiplied by a multiplication coefficient, and the multiplication coefficient is set in accordance with the oil pressure supplied from the oil pressure source.

This preferred embodiment of the cam phase control method provides the same advantageous effects as provided by the corresponding preferred embodiment of the cam phase control apparatus according to the fifth aspect of the invention.

Preferably, in the engine control unit, the control program further causes the computer to change the actual cam phase with an oil pressure supplied from an oil pressure source, multiply at least one of the time series data of the deviation making up the switching function by a multiplication coefficient, and set the multiplication coefficient in accordance with the oil pressure supplied from the oil pressure source.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the multiplication coefficient is set such that the deviation decreases at a lower rate as a differential pressure between the oil pressure and a predetermined reference pressure is larger.

In this type of cam phase varying means, it has been confirmed that the actual cam phase optimally converges to the target cam phase when the oil pressure supplied from the oil pressure source is at a predetermined pressure; more susceptible to overshoot the target cam phase as the oil pressure is higher than the predetermined pressure; and more slowly converges to the target cam phase as the oil pressure is lower than the predetermined pressure (see FIG. 6). Therefore, according to this preferred embodiment of the cam phase control apparatus for an internal combustion engine, with the predetermined reference pressure set as the predetermined pressure as mentioned above, the deviation decreases at a lower rate when the oil pressure is higher than the predetermined reference pressure to prevent the actual cam phase from overshooting the target cam phase, whereas the deviation decreases at a higher rate when the oil pressure is lower than the predetermined reference pressure to appropriately increase the rate at which the actual cam phase converges to the target cam phase.

Preferably, in the cam phase control apparatus for an internal combustion engine, the multiplication coefficient is set such that the deviation decreases at a lower rate as a differential pressure between the oil pressure and a predetermined reference pressure is larger.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the multiplication coefficient is set such that the deviation decreases at a lower rate as a differential pressure between the oil pressure and a predetermined reference pressure is larger.

This preferred embodiment of the cam phase control method provides the same advantageous effects as provided by the corresponding preferred embodiment of the cam phase control apparatus according to the fifth aspect of the invention.

Preferably, in the engine control unit, the multiplication coefficient is set such that the deviation decreases at a lower rate as a differential pressure between the oil pressure and a predetermined reference pressure is larger.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the oil pressure source supplies the cam phase varying means with an oil used in the internal combustion engine, and the multiplication coefficient is set such that the deviation decreases at a lower rate as a shorter time has elapsed from a start of the internal combustion engine.

Generally, in this type of cam phase varying device, the actual cam phase changes more slowly, as the temperature of the oil supplied from the oil pressure source is lower, due to a larger viscous resistance of the oil. Consequently, a degraded responsibility causes an instable behavior of the actual cam phase. For this reason, a low oil temperature may cause an instable behavior of the actual cam phase immediately after the internal combustion engine is started. On the other hand, according to this preferred embodiment of the cam phase control apparatus for an internal combustion engine, since the rate at which the deviation decreases is set lower as a shorter time has elapsed from the start of the internal combustion engine, the responsibility of the control is made lower as the temperature of the oil is lower to make the actual cam phase more susceptible to an instable behavior, thereby making it possible to appropriately converge the actual cam phase to the target cam phase, while compensating the actual cam phase for an instable condition immediately after the start of the internal combustion engine, to ensure the stability for the control.

Preferably, in the cam phase control apparatus for an internal combustion engine, the oil pressure source supplies the cam phase varying device with an oil used in the internal combustion engine, and the multiplication coefficient is set such that the deviation decreases at a lower rate as a shorter time has elapsed from a start of the internal combustion engine.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the oil pressure source supplies an oil used in the internal combustion engine, and the multiplication coefficient is set such that the deviation decreases at a lower rate as a shorter time has elapsed from a start of the internal combustion engine.

This preferred embodiment of the cam phase control method provides the same advantageous effects as provided by the corresponding preferred embodiment of the cam phase control apparatus according to the fifth aspect of the invention.

Preferably, in the engine control unit, the oil pressure source supplies an oil used in the internal combustion engine, and the multiplication coefficient is set such that the deviation decreases at a lower rate as a shorter time has elapsed from a start of the internal combustion engine.

This preferred embodiment of the engine control unit provides the same advantageous effects as provided by the corresponding preferred embodiment of the cam phase control apparatus according to the fifth aspect of the invention.

Preferably, in the cam phase control apparatus for an internal combustion engine, the cam phase varying means is configured to change the actual cam phase with an oil supplied from an oil pressure source for use by the internal combustion engine, at least one of the time series data of the deviation making up the switching function is multiplied by a multiplication coefficient, and the multiplication coefficient is set such that the deviation decreases at a lower rate as a shorter time has elapsed from a start of the internal combustion engine.

According to this preferred embodiment of the cam phase control apparatus for an internal combustion engine, since the rate at which the deviation decreases is set lower as a shorter time has elapsed from the start of the internal combustion engine, the responsibility of the control is made lower as the temperature of the oil is lower to make the actual cam phase more susceptible to an instable behavior, thereby making it possible to appropriately converge the actual cam phase to the target cam phase, while compensating the actual cam phase for an instable condition immediately after the start of the internal combustion engine, to ensure the stability for the control.

Preferably, in the cam phase control apparatus for an internal combustion engine, the cam phase varying device is configured to change the actual cam phase with an oil supplied from an oil pressure source for use by the internal combustion engine, at least one of the time series data of the deviation making up the switching function is multiplied by a multiplication coefficient, and the multiplication coefficient is set such that the deviation decreases at a lower rate as a shorter time has elapsed from a start of the internal combustion engine.

This preferred embodiment of the cam phase control apparatus provides the same advantageous effects as provided by the corresponding preferred embodiment of the cam phase control apparatus according to the fifth aspect of the invention.

Preferably, in the cam phase control method for an internal combustion engine, the step of changing the actual cam phase includes changing the actual cam phase with an oil supplied from an oil pressure source for use by the internal combustion engine, wherein at least one of the time series data of the deviation making up the switching function is multiplied by a multiplication coefficient, and the multiplication coefficient is set such that the deviation decreases at a lower rate as a shorter time has elapsed from a start of the internal combustion engine.

This preferred embodiment of the cam phase control method provides the same advantageous effects as provided by the corresponding preferred embodiment of the cam phase control apparatus according to the fifth aspect of the invention.

Preferably, in the engine control unit, the control program further causes the computer to change the actual cam phase with an oil supplied from an oil pressure source for use by the internal combustion engine, multiply at least one of the time series data of the deviation making up the switching function by a multiplication coefficient, and set the multiplication coefficient such that the deviation decreases at a lower rate as a shorter time has elapsed from a start of the internal combustion engine.

This preferred embodiment of the engine control unit provides the same advantageous effects as provided by the corresponding preferred embodiment of the cam phase control apparatus according to the fifth aspect of the invention.

BRIEF DESCRIPTION OF THE DRAWINGS

FIG. 5 shows equations for calculating a control input DUT in accordance with a basic adaptive sliding mode control algorithm;

DETAILED DESCRIPTION OF THE PREFERRED EMBODIMENTS

Figure 1:
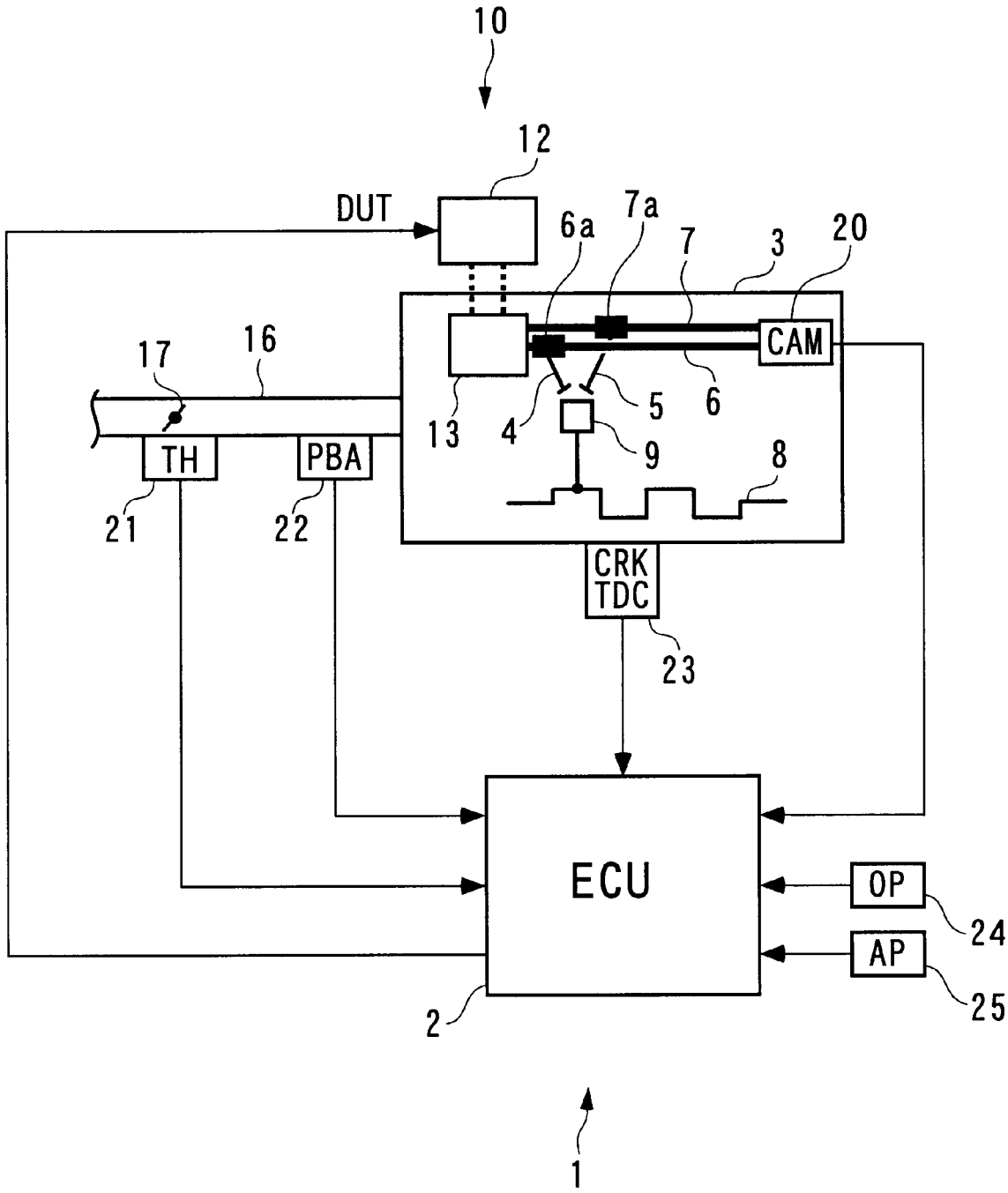
FIG. 1 is a schematic diagram generally illustrating the configuration of a cam phase control apparatus according to the present invention and an internal combustion engine which applies the cam phase control apparatus.

In the following, a cam phase control apparatus for an internal combustion engine according to one embodiment of the present invention will be described with reference to the accompanying drawings. FIG. 1 generally illustrates the configuration of a cam phase control apparatus according to this embodiment, and an internal combustion engine which applies the cam phase control apparatus. As illustrated in FIG. 1, the cam phase control apparatus 1 comprises a cam phase varying device 10 for changing an actual cam phase CAIN, as described later, an ECU 2 (which implements cam phase detecting means, operating condition detecting means, target cam phase setting means, and sampling means) for controlling the cam phase varying device 10, and the like.

The internal combustion engine (hereinafter simply called the "engine") 3 is a four-cycle DOHC type gasoline engine which comprises an intake cam shaft 6 and an exhaust cam shaft 7. The intake cam shaft 6 has an intake cam 6*a* for driving an intake valve 4 to open and close, while the exhaust cam shaft 7 has an exhaust cam 7*a* for driving an exhaust valve 5 to open and close. These intake and exhaust cam shafts 6, 7 are coupled to a crank shaft 8 through a timing belt, not shown, so that they are rotated once each time the crank shaft 8 is rotated twice.

Figure 2:
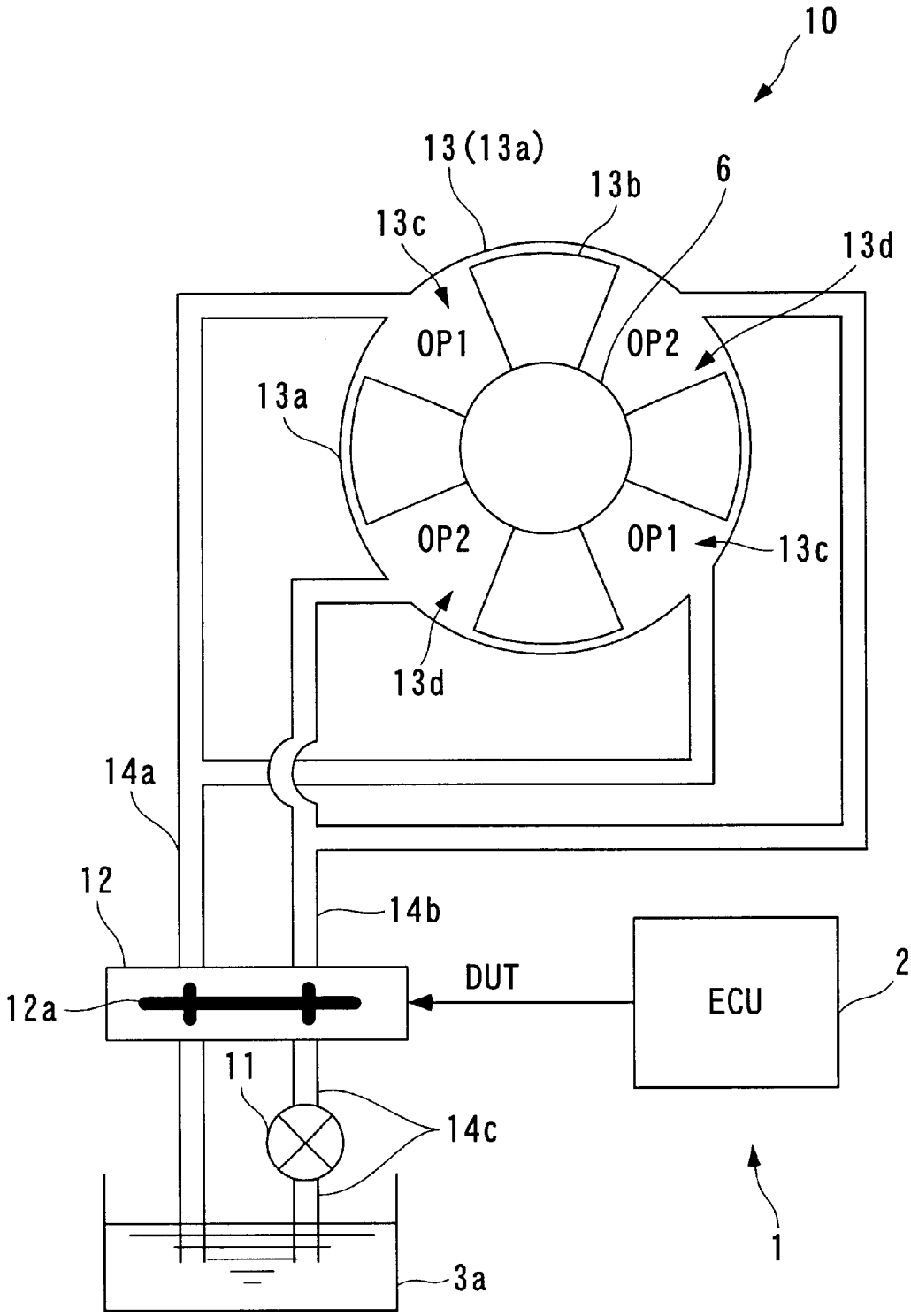
FIG. 2 is a schematic diagram generally illustrating the configuration of a cam phase varying device.

The cam phase varying device 10 continuously advances or retards an actual phase CAIN of the intake cam 6*a* (hereinafter simply called the "actual cam phase") with respect to the crank shaft 8, and as illustrated in FIG. 2. The cam phase varying device 10 comprises a hydraulic pump 11, an electrically driven spool valve 12, a cam phase varying mechanism 13, and the like. The hydraulic pump 11, which functions as an oil pressure source, is electrically driven by the ECU 2 to suck a lubricant oil stored in an oil pan 3*a* of the engine 3 through an oil passage 14*c*, pump the sucked oil, and supply the electrically driven spool valve 12 with the pumped oil through the oil passage 14*c*.

The electrically driven spool valve 12 is connected to the cam phase varying mechanism 13 through an advance oil passage 14*a* and a retard oil passage 14*b* for outputting an oil pressure OP supplied from the hydraulic pump 11 to the cam phase varying mechanism 13 through the advance oil passage 14*a* and retard oil passage 14*b* as an advance oil pressure OP1 and a retard oil pressure OP2, respectively. The electrically driven spool valve 12 has a spool valve body 12*a* which is movable within a predetermined stroke. The electrically driven spool valve 12 is electrically connected to the ECU 2, so that it moves the spool valve body 12*a* within the predetermined stroke in response to a driving signal from the ECU 2 in accordance with a control input DUT, later described, to change the advance oil pressure OP1 and retard oil pressure OP2 (oil pressures of two hydraulic systems).

Specifically, when the control input DUT is zero (value corresponding to a duty ratio of 50%), the spool valve body 12*a* is held at a neutral position at the center of the predetermined stroke to maintain the advance oil pressure OP1 and retard oil pressure OP2 at the same value as each other. In other words, a differential pressure DOP12 between the advance oil pressure OP1 and retard oil pressure OP2 (differential pressure between the two hydraulic systems) is maintained at zero. When the control input DUT is a positive value, the spool valve body 12*a* is moved to a position corresponding to the value to change the differential pressure DOP12 to a positive value. When the control input DUT is a negative value, the differential pressure DOP12 is changed to a negative value.

The cam phase varying mechanism 13 comprises a housing 13*a*, a vane 13*b*, and the like. The housing 13*a* comprises a sprocket, not shown, and is coupled to the crank shaft 8 through the sprocket and the timing belt for rotation associated with the rotation of the crank shaft 8 in the same direction.

The vane 13*b*, which is a four-vane type one, is attached to one end of the intake cam shaft 6 for rotation integral therewith. The vane 13*b* is housed in a housing 13*a* for relative rotation within a predetermined angular range. Two advance chambers 13*c* and two retard chambers 13*d* are formed between the vane 13*b* and housing 13*a*. The advance oil passage 14*a* has its downstream end branched into two branches, the leading ends of which are connected to the advance chambers 13*c*, respectively. In this way, each of the advance chambers 13*c* is supplied with the advance oil pressure OP1 from the electrically driven spool valve 12 through the advance oil passage 14. Likewise, the retard oil passage 14*b* also has its downstream end branched into two branches, the leading ends of which are connected to the retard chambers 13*d*, respectively. In this way, each of the retard chambers 13*d* is supplied with the retard oil pressure OP2 from the electrically driven spool valve 12 through the retard oil passage 14*b*.

In the cam phase varying device 10 described above, the electrically driven spool valve 12 is operated in response to the control input DUT to supply the advance chambers 13*c* with the advance oil pressure OP1 and the retard chambers 13*d* with the retard oil pressure OP2, respectively, during an operation of the hydraulic pump 11. In this event, when the differential pressure DOP12 between the advance oil pressure OP1 and retard oil pressure OP2 is zero (i.e., when the control input DUT is zero), the vane 13*b* is not rotated relative to the housing 13*a*, causing the cam phase varying mechanism 13 to maintain the actual cam phase CAIN in a current state. When the differential pressure DOP12 is a positive value (DUT>0), the vane 13*b* is responsively rotated relative to the housing 13*a* in an advancing direction to advance the actual cam phase CAIN. On the other hand, when the differential pressure DOP12 is a negative value (DUT<0), the vane 13*b* is responsively rotated relative to the housing 13*a* in a retarding direction to retard the actual cam phase CAIN.

A cam angle sensor 20 is provided at an end of the intake cam shaft 6 opposite to the cam phase varying mechanism 13. The cam angle sensor 20 (cam phase detecting means) comprises, for example, a magnet rotor and an MRE pickup, and outputs a pulsed CAM signal to the ECU 2 every predetermined cam angle (for example, 1°) as the intake cam shaft 6 is rotated.

A throttle valve 17 and a throttle valve opening sensor 21 are disposed in an intake pipe 16 of the engine 3. The throttle valve 17 is electrically driven, and the ECU 2 controls its opening (hereinafter called the "throttle valve opening") TH. The throttle valve opening sensor 21 (operating condition detecting means) detects the throttle valve opening TH, and outputs a detection signal indicative of the detected throttle valve opening TH to the ECU 2.

An absolute intake pipe inner pressure sensor 22 is disposed at a location of the intake pipe 16 downstream of the throttle valve 17. The absolute intake pipe inner pressure sensor 22, which comprises, for example, a semiconductor pressure sensor, detects an absolute intake pipe inner pressure PBA within the intake pipe 16, and outputs a detection signal indicative of the detected absolute intake pipe inner pressure PBA to the ECU 2.

The engine 3 is also provided with a crank angle sensor 23. The crank angle sensor 23 (operating condition detecting means) outputs a CRK signal and a TDC signal, both of which are pulse signals, to the ECU 2 as the crank shaft 8 is rotated.

One pulse of the CRK signal is outputted every predetermined crank angle (for example, 30°). The ECU 2, in response to the CRK signal, calculates a rotational speed NE of the engine 3 (hereinafter called the "engine rotational speed"), and calculates the actual cam phase CAIN based on the CRK signal and the CAM signal supplied from the aforementioned cam angle sensor 20. The TDC signal is a signal indicating that the piston 9 of each cylinder is at a predetermined crank angle position near the top dead center (TDC) at the start of an intake stroke, and one pulse is outputted every predetermined crank angle.

The ECU 2 is also connected to an oil pressure sensor 24 and an accelerator opening sensor 25. The oil pressure sensor 24 detects the oil pressure OP supplied from the hydraulic pump 11 to the electrically driven spool valve 12, and outputs a detection signal indicative of the detected oil pressure OP to the ECU 2. The accelerator opening sensor 25 detects an opening AP of an accelerator pedal (hereinafter called the "accelerator opening"), not shown, and outputs a detection signal indicative of the detected accelerator pedal opening AP to the ECU 2.

The ECU 2 is based on a microcomputer which comprises an I/O interface, a CPU, a RAM, a ROM, and the like. The CPU receives the detection signals from the aforementioned sensors 20–25, respectively, through the I/O interface. In accordance with these input signals, the ECU 2 determines an operating condition of the engine 3, and executes operations for controlling the actual cam phase CAIN at predetermined control period ΔT (2 msec in this embodiment), as will be later described. Specifically, the ECU 2 implements an adaptive sliding mode controller which calculates the control input DUT based on an adaptive sliding mode control algorithm. The ECU 2 controls the actual cam phase CAIN to a target cam phase CAINCMD by supplying the electrically driven spool valve 12 with a driving signal in accordance with the control input DUT calculated in the foregoing manner.

The following description will be centered on the adaptive sliding mode control algorithm used in this embodiment. This control algorithm first regards a controlled object including the cam phase varying device 10 as a system which receives the control input DUT and outputs the actual cam phase CAIN, and models the controlled object as an ARX model (auto-regressive model with exogenous input), which is a discrete time based mode, as expressed by the following equation (1):

$$CAIN(n+1)=a1\cdot CAIN(n)+a2\cdot CAIN(n-1)+b1\cdot DUT(n) \quad (1)$$

where CAIN(n) represents sample data of the actual cam phase CAIN; DUT(n) sample data of the control input DUT; n+1, n, n−1 the order of sampling cycles for respective data;

and a1, a2, b1 model parameters. In this embodiment, a sampling period ΔTs is set to a value five times as long as the control period ΔT (10 msec).

By thus modeling the controlled object as a discrete time based model, the model parameters a1, a2, b1 can be more accurately and readily identified by a general identification algorithm such as a least square method than a conventional algorithm which relies on a continuous time based model. In addition, an on-board identifier (for example, described in Laid-open Japanese Patent Application No. 11-153051) can be added to the cam phase control apparatus 1, in which case the model parameters a1, a2, b1 can be appropriately and readily identified in real time, thereby improving the controllability. Further, since the actual cam phase CAIN and control input DUT are sampled at the sampling period ΔTs longer than the control period ΔT, a dynamic characteristic of the controlled object can be appropriately reflected to the discrete time based model in a frequency range in which the power spectrum of the target cam phase CAINCMD exists for the reason described above.

Alternatively, the controlled object may be modeled as a third-order or more ARX model, not limited to the second-order ARX model expressed by the equation (1).

Next, description will be made how the adaptive sliding mode controller is set. When the foregoing discrete time based model is used, a switching function σ is set in the following manner. As expressed by the following equation (2), when a following error e is defined as a deviation of the actual cam phase CAIN from the target cam phase CAINCMD, the switching function σ is set as a linear function of time-series data of the following error e, as expressed by the following equation (3):

$$e(n)=CAIN(n)-CAINCMD(n) \tag{2}$$

$$\sigma'(n)=e(n)+S'\cdot e(n-1) \tag{3}$$

where n represents the order of sampling cycle, and S' a switching function setting parameter.

As described above, since the sampling period ΔTs is set to the value five times as long as the control period ΔT, the following equation (4) is derived when the equation (3) is expressed by the time-series data of the following error e sampled at the control period:

$$\sigma'(k)=e(k)+S'\cdot e(k-5) \tag{4}$$

where k represents the order of control cycle.

For comparison, when the following error e is sampled at a sampling period equal to the control period ΔT, a switching function σ" is expressed by the following equation (5):

$$\sigma''(k)=e(k)+S''\cdot e(k-1) \tag{5}$$

where S" represents a switching function setting parameter.

Figure 3A:
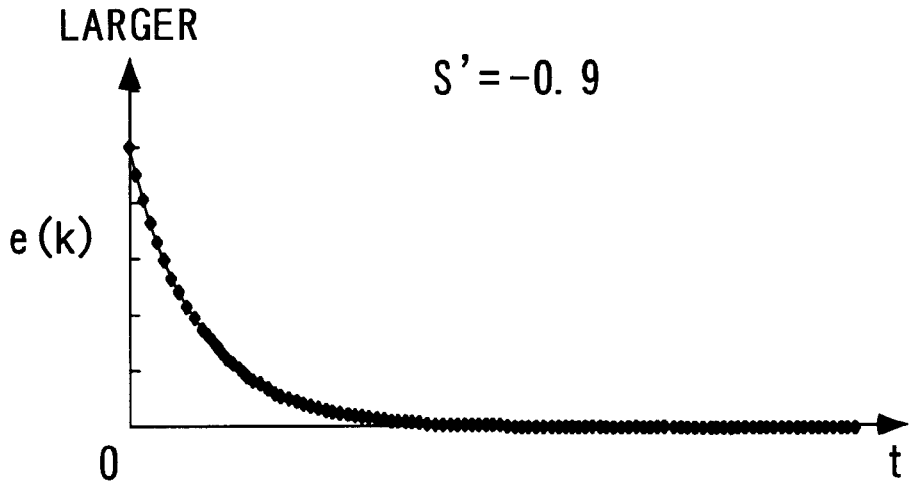
FIGS. 3A and 3B are graphs showing the attenuation characteristic curve of a following error e when a switching function setting parameter S' is set to −0.9 (FIG. 3A) and when a switching function setting parameter S" is set to −0.59 (FIG. 3B)
Figure 3B:
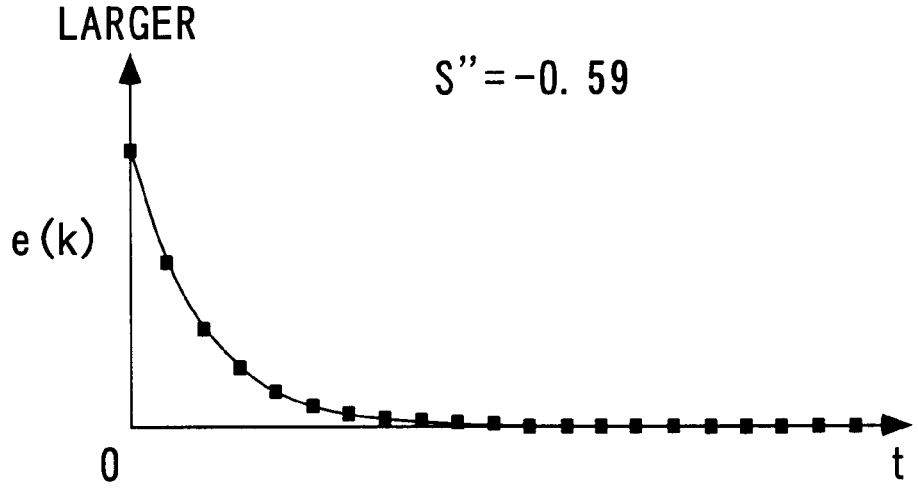

In the switching functions σ' and σ", the attenuation characteristic of the following errors e are determined by the values of the switching function setting parameters S', S", respectively, so that for comparison, the switching function setting parameters S', S" are set herein to such values (S'=−0.9, S"=−0.59) that the attenuation characteristic curves of the following errors e converge over time in the same manner, as shown in FIGS. 3A, 3B.

Figure 4:
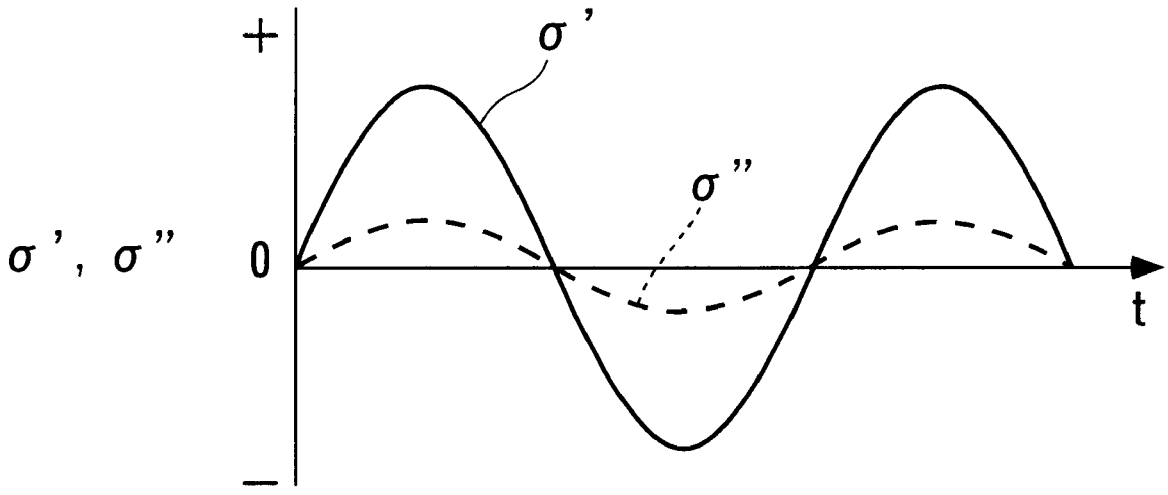
FIG. 4 is a graph showing values of the switching functions σ', σ" when a sinusoidal disturbance is inputted with the switching function setting parameters S', S" being set as shown in FIGS. 3A, 3B.

FIG. 4 shows behaviors of the switching functions σ', σ" for the actual cam phase CAIN which is oscillated in a sinusoidal form by an sinusoidal disturbance when the switching functions σ', σ" and switching function setting parameters S', S" are set as described above. Referring to FIG. 4, due to a difference in the sampling period between the following errors e constituting the switching functions σ', σ", the switching functions σ', σ" differ in the sensitivity to the disturbance from each other. It can be seen that the switching function σ' with the sampling period ΔTs set longer than the control period ΔT, has a higher sensitivity to the disturbance than the switching function σ" with the sampling period set equal to the control period ΔT. Therefore, in this embodiment, the switching function σ is set as a linear function of time-series data of the following error e which is sampled at the sampling period ΔTs five times as long as the control period ΔT, as shown in the aforementioned equation (4), based on the controlled object model.

In the sliding mode control algorithm, when the switching function σ is made up of two state variables (the time series data of the following error e in this embodiment), a phase space defined by the two state variables forms a two-dimensional phase plane in which the two state variables are represented by the vertical axis and horizontal axis, respectively, so that a combination of values of the two state variables satisfying σ=0 rests on a line called a "switching line" on this phase plane. Therefore, both the two state variables can be converged (slid) to a position of equilibrium at which the state variables take the value of zero by appropriately determining a control input to a controlled object such that a combination of the two state variables converges to (rests on) the switching line. Further, the sliding mode control algorithm can specify the dynamic characteristic, more specifically, a convergence behavior and a convergence speed of the state variables by setting the switching function σ. For example, when the switching function σ is made up of two state variables as in this embodiment, the state variables converge slower as the slope of the switching line is brought closer to one, and faster as it is brought closer to zero.

In this embodiment, as shown in the aforementioned equation (4), the switching function σ is made up of two time series data of the following error e, i.e., a current value e(k) and a preceding value e(k−5) of the following error e, so that the control input DUT to the controlled object may be set such that a combination of these current value e(k) and preceding vale e(k−5) is converged onto the switching line. Specifically, the control input DUT(k) (=Usl(k)) is set as a total sum of an equivalent control input Ueq(k), a reaching law input Urch(k), a non-linear input Unl(k), and an adaptive law input Uadp(k), as shown in equation (6) in FIG. 5, in accordance with the adaptive sliding mode control algorithm.

The equivalent control input Ueq(k) is provided for restricting the combination of the current value e(k) and preceding value e(k−5) of the following error e on the switching line, and specifically is defined as equation (7) shown in FIG. 5. The reaching law input Urch(k) is provided for converging the combination of the current value e(k) and preceding value e(k−5) of the following error e onto the switching line if it deviates from the switching line due to a disturbance, a modeling error or the like, and specifically is defined as equation (8) shown in FIG. 5.

The non-linear input Unl(k) is provided for compensating the controlled object for its non-linear characteristic, and achieving similar effects to the reaching law input Urch(k), and specifically defined as equation (10) shown in FIG. 5. The adaptive law input Uadp(k) is provided for securely converging the combination of the current value e(k) and preceding value e(k−5) of the following error e onto a switching hyperplane while preventing the influence of a steady-state deviation of the controlled object, a modeling error, and disturbance, and specifically defined as equation (9) shown in FIG. 5.

In this embodiment, for improving the controllability, the aforementioned equations (4), (6)–(10) are modified to the following equations (11)–(20) which are used to calculate the control input DUT(k):

$$\sigma(k)=e(k)+S\cdot e(k-5) \tag{11}$$

$$e(k)=CAIN(k)-CAINCMD(k) \tag{12}$$

$$S=Sop\cdot Ksast \tag{13}$$

$$DUT(k)=Usl(k)=Ueq(k)+Urch(k)+Unl(k)+Uadp(k)+Udamp(k) \tag{14}$$

$$Ueq(k)=(1/b1)\{(1-a1-S)\cdot CAIN(k)+(S-a2)\cdot CAIN(k-5)\}$$

$$Urch(k)=(-F/b1)\cdot\sigma(k) \tag{16}$$

$$Unl(k)=(-H/b1)\cdot sgn(\sigma(k)) \tag{17}$$

$$Uadp(k)=Uadp(k-1)+(-G/b1)\cdot\Delta T\cdot\sigma(k) \tag{18}$$

$$Udamp(k)=(-Q/b1)\cdot(CAIN(k)-CAIN(k-1)) \tag{19}$$

where S represents a switching function setting parameter; Sop a reference value for the switching function setting parameter; Ksast a post-start correction coefficient for the switching function setting parameter; Udamp(k) a damping input; F a gain of the reaching law input; G a gain of the adaptive law input; H a gain of the non-linear input; and Q a gain of the damping input, respectively.

Figure 6:
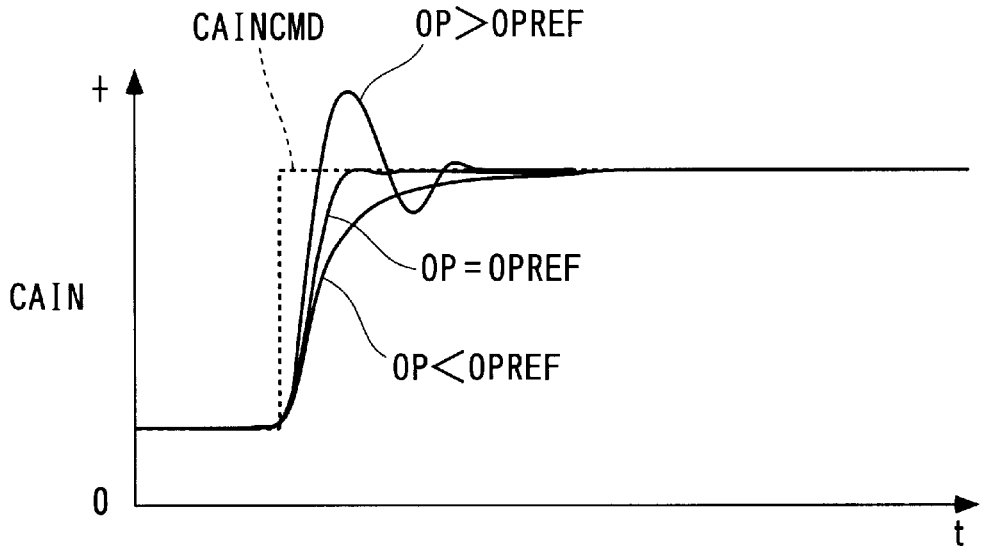
FIG. 6 is a graph showing a change in the responsibility of an actual cam phase CAIN to a target cam phase CAINCMD caused by a difference in the oil pressure OP.

Next, description will be made on improvements in the control algorithm expressed by the foregoing equations (11)–(19). Described first is an improvement on the switching function setting parameter S (multiplication coefficient) shown in equation (13). In the hydraulically driven cam phase varying device 10 as employed in this embodiment, the vane 13*b* in the cam phase varying device 13 generates a driving force which changes in response to the oil pressure OP, so that the oil pressure also affects how the actual cam phase CAIN converges to the target cam phase CAINCMD. For this reason, as shown in FIG. 6, when the target cam phase CAINCMD changes in steps, the actual cam phase CAIN exhibits an optimal responsibility when OP=OPREF, where OPREF represents a reference pressure, overshoots when OP>OPREF, and presents a response delay when OP<OPREF.

Figure 7:
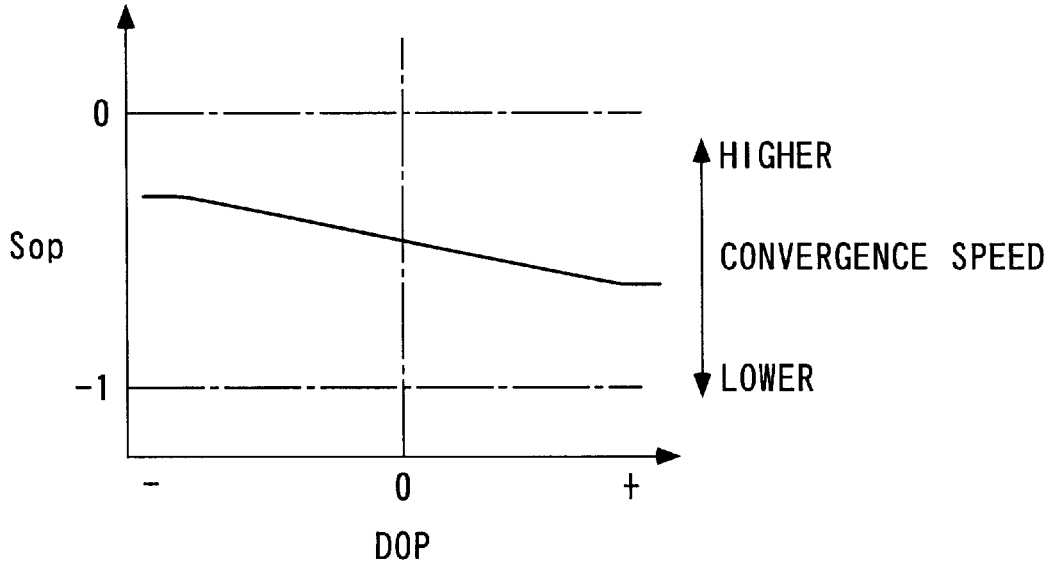
FIG. 7 shows an exemplary table for use in setting a reference value Sop for the switching function setting parameter S.
Figure 8:
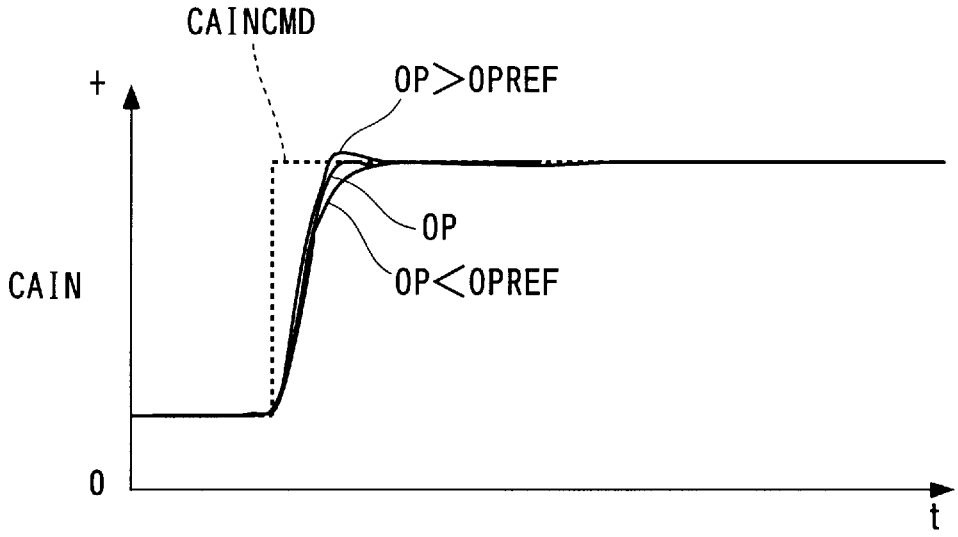
FIG. 8 is a graph showing a change in the responsibility of the actual cam phase CAIN to the target cam phase CAINCMD caused by a difference in the oil pressure DOP when using the reference value Sop set in accordance with the differential pressure OP.

To solve this inconvenience, in this embodiment, the reference value Sop in equation (13) is set as shown in a table of FIG. 7 in accordance with a differential pressure DOP between the oil pressure OP and reference pressure OPREF (OP-OPREF). Specifically, the reference value Sop for the switching function setting parameter S is set to a smaller value as the differential pressure DOP is higher, so that the actual cam phase CAIN can be converged to the target cam phase CAINCMD at a lower rate as the differential pressure DOP is higher. Stated another way, the actual cam phase CAIN can be converged to the target cam phase CAINCMD at a higher rate as the differential pressure DOP is lower. The reference value Sop thus set in accordance with the differential pressure DOP can prevent the actual cam phase CAIN from overshooting when OP>OPREF, and compensate the actual cam phase CAIN for a response delay when OP<OPREF, as shown in FIG. 8.

Further, in the hydraulically driven cam phase varying device 10 as employed in this embodiment, the actual cam phase CAIN changes more slowly as the oil temperature is lower due to a larger viscous resistance of the oil, and a larger oil leak in the oil passage within the electrically driven spool valve 12. Consequently, a degraded responsibility causes an instable behavior of the actual cam phase CAIN. For this reason, in this embodiment which uses the lubricant oil for the engine 3, a low oil temperature may cause an instable behavior of the actual cam phase CAIN immediately after the engine 3 is started. To compensate for the instable behavior of the actual cam phase CAIN, the post-start correction coefficient Ksast in the aforementioned equation (13) is set as shown in a table of FIG. 9 in accordance with a timer value Tmast of a post-start timer which measures an elapsed time after the start of the engine 3. Specifically, the post-start correction coefficient Ksat is set to a larger value as the timer value Tmast is smaller. Stated another way, the post-start correction coefficient Ksat is set such that the deviation decreases at a lower rate as a shorter time has elapsed after the start of the engine and as the oil temperature is lower. In this way, the actual cam phase CAIN can be appropriately converged to the target cam phase CAINCMD while compensating for an instable condition of the actual cam phase CAIN immediately after the start of the engine 3.

Next described is an improvement on the control input DUT(k) expressed by the aforementioned equation (14). As is apparent from a comparison of equation (14) with equation (6) in FIG. 5, the control input DUT(k) expressed by equation (14) is the sum of the control input DUT(k) of equation (6) and the damping input Udamp(k). The damping input Udamp(k) is added to the control input DUT(k) for the following reason.

In the hydraulically driven cam phase varying device 10, when the target cam phase CAINCMD changes at a high rate, the actual cam phase CAIN overshoots the target cam phase CAINCMD due to the inertia of the vane 13*b* as well as the inertia, compressibility and the like of the hydraulic system, so that the damping input Udamp(k) must be added to the control input DUT(k) to prevent the overshooting. In this event, since the damping input Udamp(k) should be set as a force which acts to reduce an excessively high rate at which the actual cam phase CAIN changes, the following three inputs Udamp1(k)–Udamp3(k) are contemplated as candidates for the damping input Udamp(k):

$$Udamp1(k)=(-Q1/b1)\cdot(CAIN(k)-CAIN(k-1) \tag{19a}$$

$$Udamp2(k)=(-Q2/b1)\cdot(\sigma(k)-\sigma(k-1)) \tag{19b}$$

$$Udamp3(k)=(-Q3/b1)\cdot(e(k)-e(k-1)) \tag{19c}$$

where Q1–Q3 represent gains of the respective damping inputs.

In these three equations (19a)–(19c), the values of the switching function σ(k) and deviation e(k) become larger when the target cam phase CAINCMD changes as well as when the actual cam phase CAIN changes. As such, if the input Udamp2(k) or Udamp3(k) is used with the intention to limit the overshooting, the actual cam phase CAIN will respond to the target cam phase CAINCMD at a reduced rate. In this embodiment, therefore, the input Udamp1(k) expressed by equation (19a), i.e., the damping input Udamp (k) expressed by the aforementioned equation (19) is used to simultaneously provide an overshoot limiting effect and a high responsibility.

Figure 10:
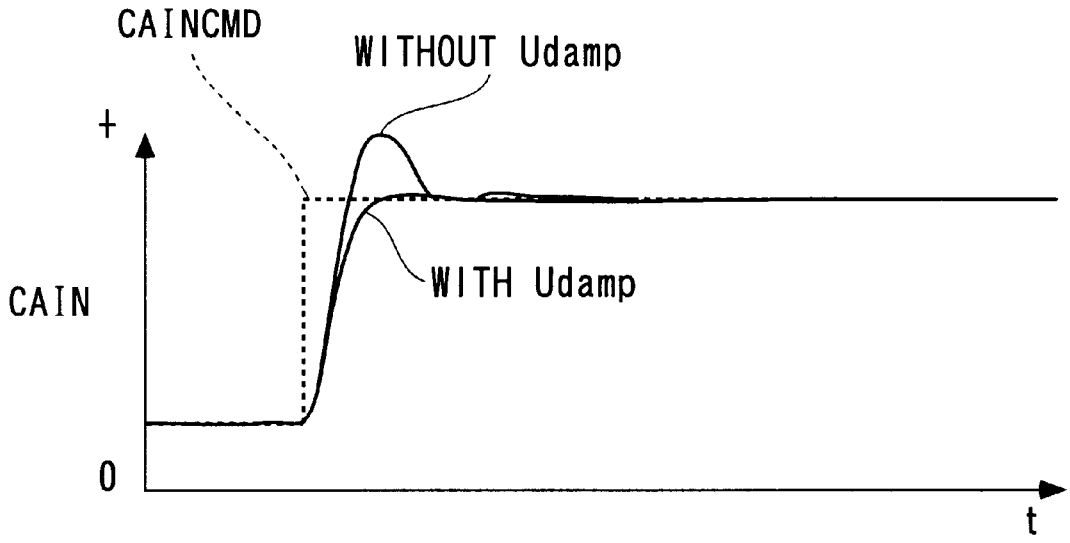
FIG. 10 is a graph showing a change in the responsibility of the actual cam phase CAIN to the target cam phase CAINCMD when a damping input Udamp is included in the control input DUT and when it is not included.

FIG. 10 shows, for purposes of comparison, the results of simulations made for the responsibility of the actual cam phase CAIN to the target cam phase CAINCMD when the control input DUT(k) is calculated in accordance with the equation (14) which includes the damping input Udamp(k) and when the control input DUT(k) is calculated in accordance with equation (6) which does not include the damping input Udamp(k). From a comparison of these simulation results, it can be found that the addition of the damping input Udamp(k) can limit the overshooting of the actual cam phase CAIN to the target cam phase CAINCMD even when the target cam phase CAINCMD suddenly changes.

Next described is an improvement on the adaptive law input Uadp(k) expressed by the foregoing equation (18). When using the adaptive law input Uadp(k) expressed by equation (9) in FIG. 5, the actual cam phase CAIN can be limited in steady-state deviation and modeling error, whereas the actual cam phase CAIN is more likely to overshoot the target cam phase CAINCMD because integrated switching function σ' is multiplied by a constant gain G' at all times. To avoid this inconvenience, in this embodiment, the adaptive law input Uadp(k) is calculated in the following manner in order to effectively prevent the actual cam phase CAIN from overshooting the target cam phase CAINCMD as well as limit the actual cam phase CAIN in steady-state deviation and modeling error.

Figure 11:
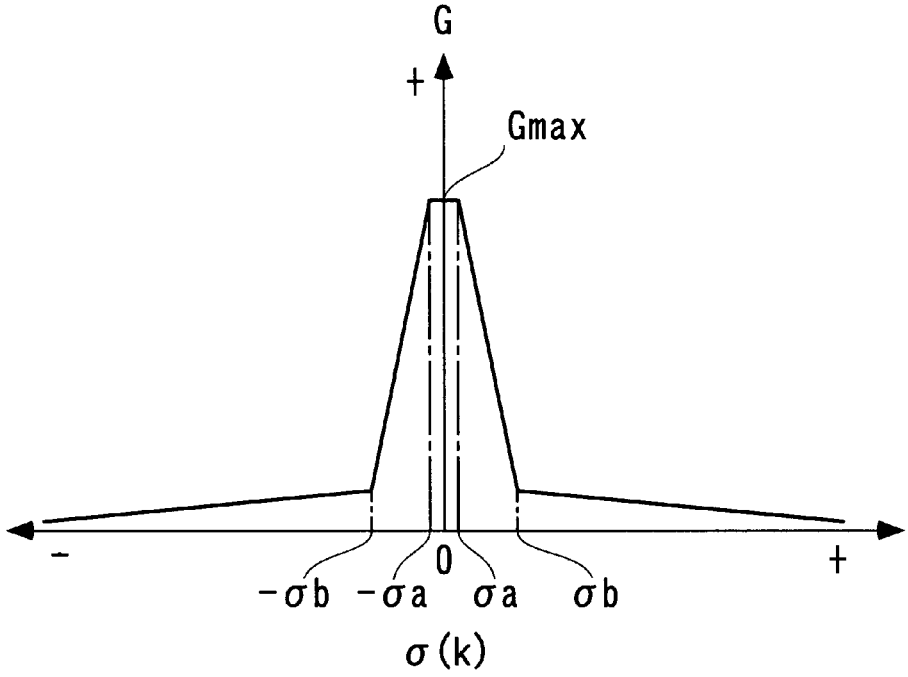
FIG. 11 is an exemplary table for use in setting a gain G of an adaptive law input Uadp.

The Gain G of the adaptive law input Uadp(k) is scheduled (i.e., varied) as shown in FIG. 11, and the adaptive law input Uadp(k) is calculated in accordance with equation (18) instead of equation (9) for preventing a sudden change in the adaptive law input Uadp(k) when the gain G is changed.

In a table shown in FIG. 11, the value of the gain G is set in accordance with the switching function σ(k). Specifically, the gain G is set symmetrically to positive and negative values of the switching function σ(k), and is set to a predetermined maximum value Gmax when σ(k) lies within a predetermined range near zero ($-\sigma a \leqq \sigma(k) \leqq \sigma a$). Such settings are made to prevent the overshooting caused by the integration characteristic of the adaptive law input Uadp(k) by setting the gain G to the maximum value Gmax when the deviation e converges to zero with σ(k) lying near zero, i.e., when the actual cam phase CAIN approaches to the target cam phase CAINCMD. Also, the gain G is set to a smaller value as σ(k) is larger in a range $\sigma a < \sigma(k)$, and set to change at a larger degree in a range $\sigma a < \sigma(k) < \sigma b$ than in a range $\sigma b \leqq \sigma(k)$. This setting is made to prevent a sudden change in the adaptive law input Uadp(k) when the gain G is changed to the maximum value Gmax.

Figure 12:
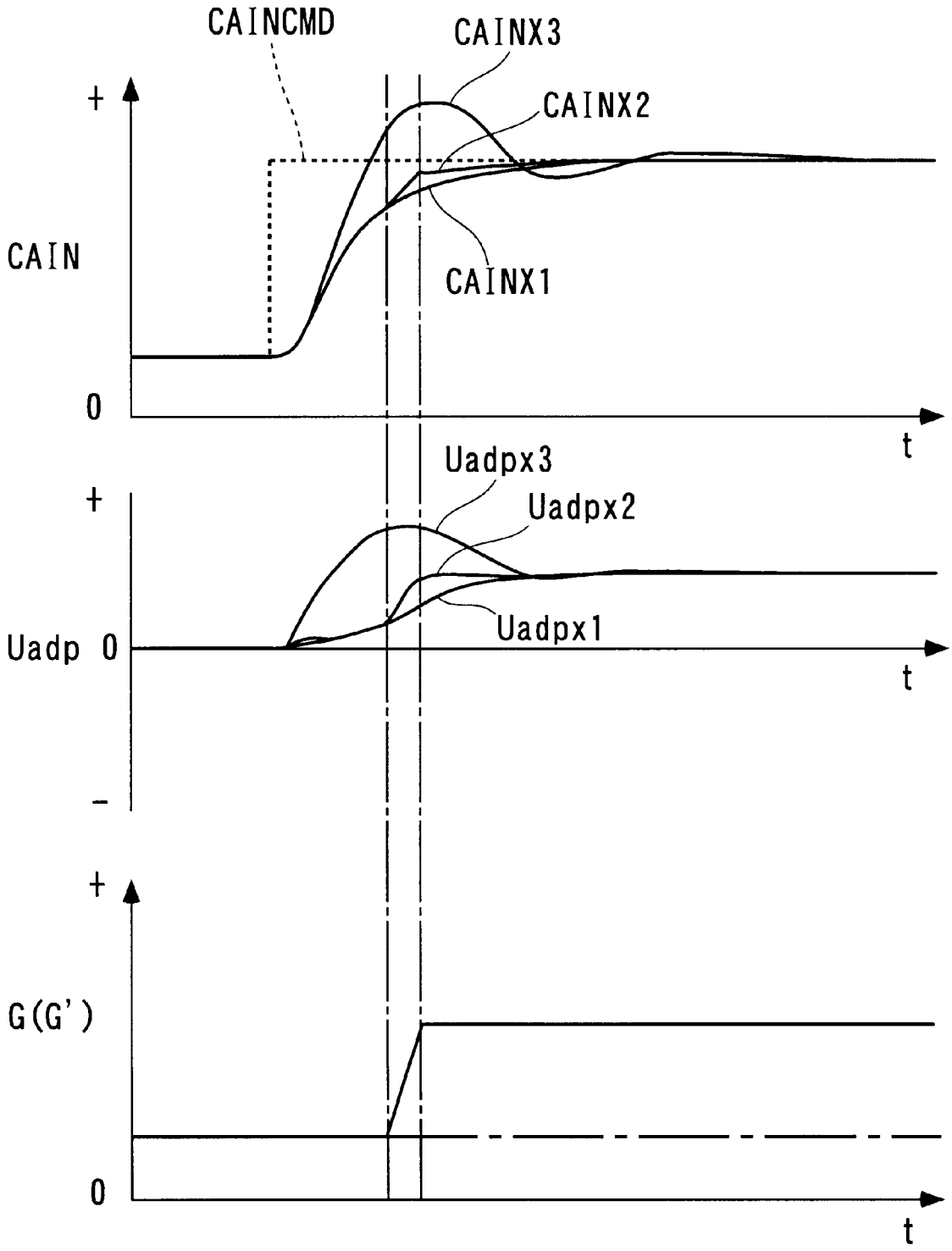
FIG. 12 is a graph showing a change in the responsibility of the actual cam phase CAIN to the target cam phase CAINCMD caused by different equations for calculating an adaptive law input Uadp and different gains set therefor.

FIG. 12 shows the results of simulations made for the responsibility of the actual cam phase CAIN to the target cam phase CAINCMD when using the control input DUT(k) which includes the adaptive law input Uadp(k) that is set in the foregoing manner. In FIG. 12, a curve CAINX1 and a curve Uadpx1 indicate the result of the simulation when using the adaptive law input Uadp(k) expressed by equation (18) including the variable gain G. A curve CAINX2 and a curve Uadpx2 in turn indicate the result of the simulation, made for comparison, when using the adaptive law input Uadp(k) expressed by equation (6) which includes scheduled gain G' in a manner similar to the gain G. A curve CAINX3 and a curve Uadpx3 indicate the result of the simulation when using the adaptive law input Uadp(k) expressed by equation (6) which includes a constant gain G'.

From a comparison of these simulation results with one another, it can be found that the adaptive law input Uadp(k) calculated in accordance with equation (18) including the scheduled gain G contributes to the prevention of the actual cam phase CAIN from overshooting, the prevention of the adaptive law input Uadp(k) from a sudden change when the gain G is changed to the maximum value Gmax, and the prevention of the actual cam phase CAIN from a discontinuous behavior otherwise resulting from the sudden change.

In FIG. 11, the gain G is set (scheduled) in accordance with the switching function σ(k), but instead, the gain G may be set in accordance with the deviation e(k), actual cam phase CAIN(k), or control input DUT(k). In addition, while the gain G is set symmetrically to the positive and negative values of the switching function σ(k), the gain G may be set asymmetrically. Further, the gain G may be corrected in accordance with an environmental condition and an operating condition of the engine 3.

Next described is an improvement on the non-linear input Unl(k) expressed by the aforementioned equation (17). In the cam phase varying device 10 equipped with the electrically driven spool valve 12 as in this embodiment, when the spool valve body 12*a* is near the neutral position, i.e., when the control input DUT is near zero with the differential pressure DOP 12 near zero, the actual cam phase CAIN presents the most instable behavior due to non-linear characteristics such as a hysteresis characteristic, a dead band characteristic and the like, and due to a leakage of oil within the spool. In addition, different characteristics are generally presented when the control input DUT(k) is in a positive region and in a negative region, i.e., when the actual cam phase CAIN is advanced and retarded.

Figure 13:
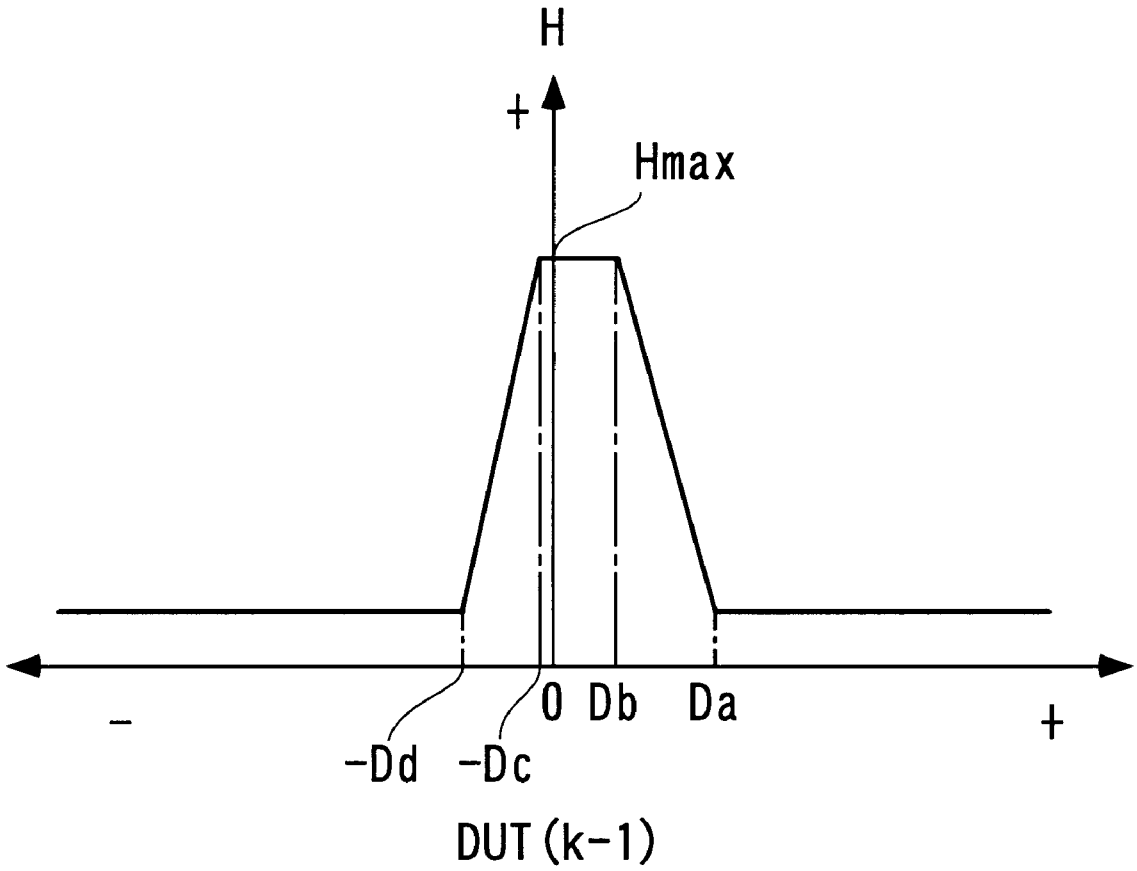
FIG. 13 is an exemplary table for use in setting a gain H of a non-linear input.

To compensate such a characteristic, the non-linear input Unl(k) expressed by equation (17) has the gain H scheduled as shown in FIG. 13. Specifically, the gain H is set in different manners from each other for the preceding value DUT(k−1) of the control input in a positive region and in a negative region, for supporting the different characteristics of the actual cam phase CAIN when it is advanced and retarded. In addition, for compensating the actual cam phase CAIN for the most instable behavior when the spool valve body 12*a* is near the neutral position, the gain H is set to a predetermined maximum value Hmax when DUT(k−1) is within a predetermined range near zero ($-Dc \leqq DUT(k-1) \leqq Db$). Stated another way, the gain H is set to the maximum value Hmax when the differential pressure DOP 12 is within the predetermined range including zero, and when the spool valve body 12*a* is within the predetermined range including the neutral position.

The gain H is also set to a predetermined constant value in ranges $Da \leqq DUT(k-1)$ and $DUT(k-1) \leqq -Dd$. Further, for preventing a sudden change in the actual cam phase CAIN when the gain H is changed to the maximum value Hmax, the gain H is set to a smaller value as DUT(k−1) is larger in a range $db < DUT(k-1) < Da$, and is set to a smaller value as DUT(k−1) is smaller in a range $-Dd < DUT(k-1) < -Dc$.

In the gain table, the gain H may be set in accordance with the differential pressure DOP12 or a filtered value of the differential pressure DOP12 (for example, a moving average value) instead of the preceding value DUT(k−1) of the control input. Also, in equation (17), the model parameter b1 may be set to a different value depending on whether or not the preceding value DUT(k−1) of the control value is positive or negative. Further, the gain F of the reaching law input Urch(k) expressed by the aforementioned equation (16) may be scheduled (i.e., varied) in a manner similar to the gain G of the adaptive law input Uadp(k) or the gain H of the non-linear input Unl(k).

Moreover, while the aforementioned equation (8) in FIG. 5 includes the next sample value CAINCMD(k+5) of the target cam phase CAINCMD, the use of this value is impossible in an actual calculation, so that the equivalent control input Ueq(k) is actually calculated in accordance with the aforementioned equation (15). This equation (15) is derived by approximately setting CAINCMD(k+5) equal to CAINCMD(k) and CAINCMD(k−5) (CAINCMD(k+5)= CAINCMD(k)=CAINCMD(k−5)).

The number of state variables (time series data of the following error e in this embodiment) making up the switching function σ is not limited to two as described above, but may be three or more. When the switching function σ has three state variables, the resulting phase space is three-dimensional, so that a combination of three state variable satisfying σ=0 rests on a plane called a "switching plane." With four or more state variables, a combination of four or more variables satisfying σ=0 results in a plane called a "switching hyperplane" which cannot be geometrically drawn. The control input DUT to the controlled object is determined such that the combination of the state variables making up the switching function σ converges to the switching plane or switching super-plane.

Figure 14:
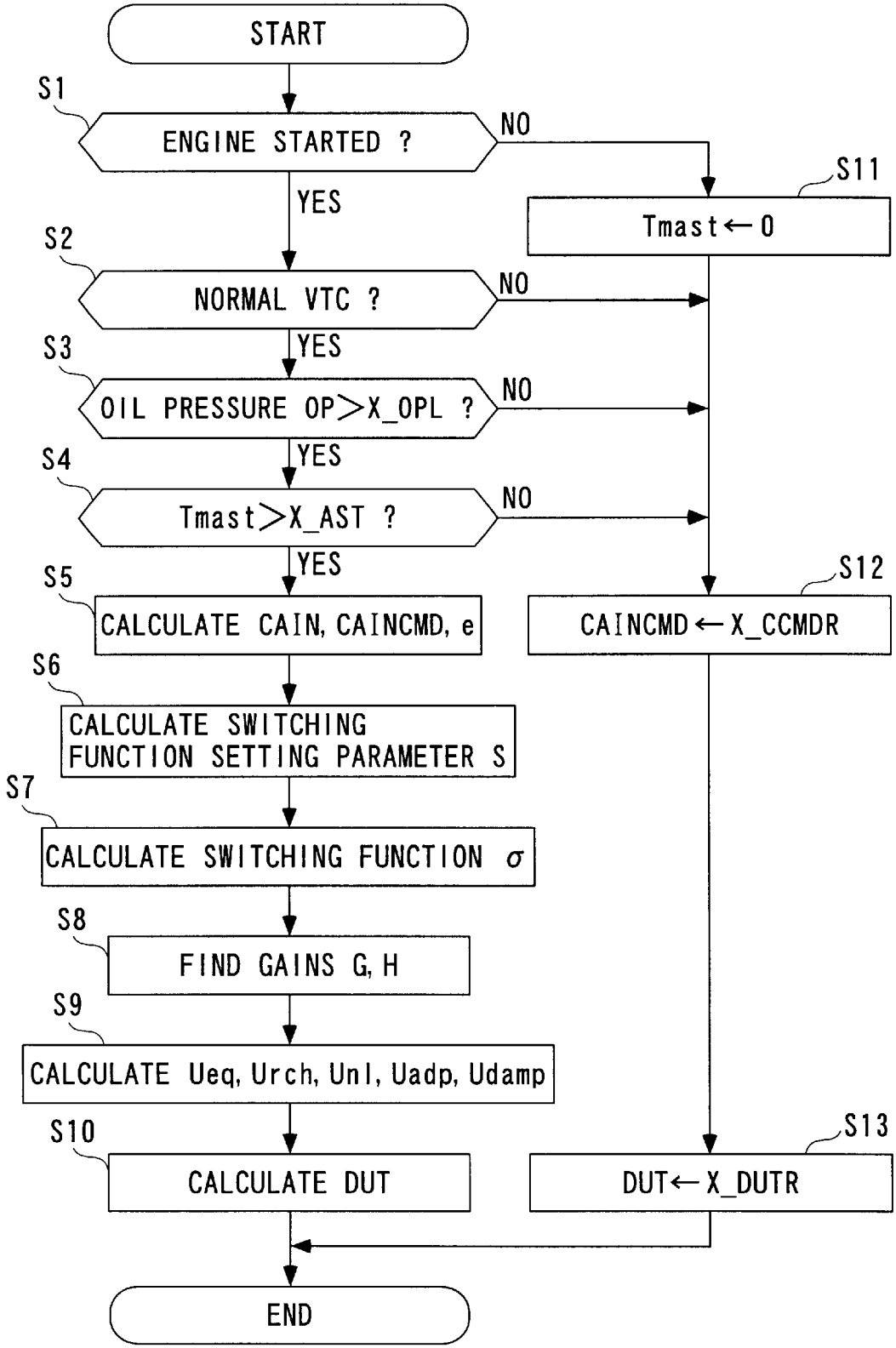
FIG. 14 is a flow chart illustrating a routine which applies an adaptive sliding mode control algorithm for controlling the actual cam phase CAIN.

Next, a routine executed by the ECU 2 for controlling the actual cam phase CAIN based on the foregoing adaptive sliding mode control algorithm will be described with reference to FIG. 14. This routine is executed at the aforementioned control period ΔT (alternatively, the routine may be executed in synchronism with a timing corresponding to the engine rotational speed NE, for example, the generation of a CRK signal, in which case the sampling period of each time series data may be set to an integer multiple of the period at which the CRK signal is generated (for example, the period at which the TDC signal is generated)).

First, in this routine, it is determined at step 1 (labelled "S1" in FIG. 14) whether or not the engine 3 has been started. Specifically, it is determined based on the engine rotational speed NE that the engine 3 has been started when the engine 3 had completed cranking.

If the result of determination at step 1 is NO, i.e., when the engine 3 has not been started, the routine proceeds to step 11, where the ECU 2 sets the timer value Tmast of the up-counting post-start timer to zero. Next, the routine proceeds to step 12, where the ECU 2 sets the target cam phase CAINCMD to the most retarded predetermined value X_CCMDR. Next, the routine proceeds to step 13, where the ECU 2 sets the control input DUT to a predetermined value X_DUTR for holding the actual cam phase CAIN at the most retarded position, followed by termination of the routine.

On the other hand, if the result of determination at step 1 is YES, i.e., when the engine 3 has been started, it is determined at steps 2–4 whether or not the following three conditions (a)–(c) are all met:

(a) the cam phase varying device (VTC) 10 is normal;

(b) the oil pressure OP is higher than a predetermined lower limit value X_OPL; and (c) the timer value Tmast of the post-start timer is larger than a predetermined value X_AST.

If at least one of the three conditions (a)–(c) is not met at steps 2–4, the ECU 2 executes the aforementioned steps 12, 13, followed by termination of the routine. On the other hand, if the three conditions (a)–(c) are all met, the routine proceeds to step on the assumption that the control input DUT should be calculated in accordance with the adaptive sliding mode control algorithm, where the ECU 2 calculates the actual cam phase CAIN, target cam phase CAINCMD, and following error e.

Specifically, the ECU 2 calculates the actual cam phase CAIN based on the CRK signal and CAM signal; retrieves the target cam phase CAINCMD from a map, not shown, in accordance with the engine rotational speed NE and throttle valve opening TH; and calculates the following error e from these actual cam phase CAIN and target cam phase CAINCMD.

Alternatively, the target cam phase CAINCMD may be retrieved in accordance with other parameters representative of the operating condition of the engine 3 instead of the engine rotational speed NE and throttle valve opening TH. For example, the target cam phase CAINCMD may be retrieved from the map in accordance with the engine rotational speed NE and absolute intake pipe inner pressure PBA or in accordance with the engine rotational speed NE and accelerator opening AP.

Next, the routine proceeds to step 6, where the ECU 2 calculates the switching function setting parameter S. Specifically, the ECU 2 calculates the differential pressure DOP between the oil pressure OP and reference pressure OPREF, and searches the table shown in FIG. 7 in accordance with the differential pressure DOP to find the reference value Sop for the switching function setting parameter S, as described above. Simultaneously with this, the ECU 2 searches the table shown in FIG. 9 in accordance with the timer value Tmast of the post-start timer to find the post-start correction coefficient Ksast. Then, as shown in equation (13), the ECU 2 multiplies the reference value Sop by the post-start correction coefficient Ksast to calculate the switching function setting parameter S.

Next, the routine proceeds to step 7, where the ECU 2 calculates the switching function σ in accordance with the aforementioned equations (11), (12) using the following error e and switching function setting parameter S respectively calculated at steps 5, 6, and the preceding sample value e(k−5) of the following error e stored in the RAM.

Next, the routine proceeds to step 8, where the ECU 2 finds the gain H of the adaptive law input Uadp and the gain G of the non-linear input Unl. Specifically, as described above, the ECU 2 searches the table shown in FIG. 13 in accordance with the preceding value DUT(k−1) of the control input to find the gain H of the adaptive law input Uadp, and finds the gain G of the non-linear input Unl from the gain of the non-linear input shown in FIG. 11 in accordance with the switching function σ calculated at step 7.

Next, the routine proceeds to step 9, where the ECU 2 calculates the equivalent control input Ueq, reaching law input Urch, non-linear input Unl, adaptive law input Uadp, and damping input Udamp, respectively, in accordance with the aforementioned equations (15)–(19) using a variety of values stored in the RAM in addition to the actual cam phase CAIN, switching function setting parameter S, gain H of the adaptive law input Uadpt, and gain H of the non-linear input Unl calculated at steps 5–8, respectively.

Next, the routine proceeds to step 10, where the ECU 2 calculates the control input DUT as the total sum of the variety of inputs Ueq, Urch, Urch, Unl, Uadp, Udamp calculated at step 9, as shown in the aforementioned equation (14), followed by termination of this routine.

As described above, the controlled object is modeled as a discrete time based model as expressed by equation (1), so that the cam phase control apparatus 1 according to this embodiment can more readily identify the model parameters a1, a2, b1 in accordance with a general identification algorithm such as a least square method based on data obtained from experiments and simulations than the conventional cam phase control apparatus which relies on a continuous time based model. For the same reason, an on-board identifier can be added to the cam phase control apparatus, in which case the model parameters a1, a2, b1 can be appropriately and readily identified in real time to improve the controllability. Further, the on-board identifier may be replaced with a model parameter scheduler, when the hardware need not be compensated for variations in characteristics and aging changes in characteristics, to set the model parameters a1, a2, b1 in accordance with the actual cam phase CAIN, oil pressure OP and the like, thereby improving the controllability.

Since the discrete time based model is made up of time series data of the control input DUT and actual cam phase CAIN sampled at the sampling period ΔTs longer than the control period ΔT, a dynamic characteristic of the controlled object can be appropriately reflected to the discrete time based model in a frequency range in which the power spectrum of the target cam phase CAINCMD exists, for the reason described above, even when the control input DUT is calculated at a period at which the target cam phase CAINCMD changes, i.e., at a control period corresponding to a frequency several times as high as the frequency of the power spectrum in the hydraulically driven cam phase varying device 10 which exhibits an intense friction characteristic. As a result, the controllability can be further improved. This approach can also improve the controllability when using an optimal control (LQ, LQI), an optimal regulator inverse problem control (I-LQ), or the like which is designed based on a discrete time based model.

Also, as shown in equations (11), (12), the switching function σ is set as a linear function of the time series data of the following error e, and the sampling period ΔTs of these time series data is set longer than the control period ΔT. Thus, in the hydraulically driven cam phase varying device 10 which exhibits an intense friction characteristic, unlike the conventional cam phase control apparatus which employs a deviation changing rate as a component of a switching function, the cam phase control apparatus according to this embodiment can sample a calculated value of the following error e as a value which appropriately reflects a change in the following error e in a frequency range in which the controlled object changes in behavior associated with a change in the target cam phase CAINCMD even when the control input DUT is calculated at a control period corresponding to a frequency several times as high as the frequency of the power spectrum of the target cam phase CAINCMD. Consequently, a change in the following error e can be appropriately reflected to this as an increase/decrease in the switching function σ. Thus, since the behavior of the following error e converging to zero can be more accurately fitted to a converging behavior determined by the switching function σ, the influence on the control for the modeling error can be reduced. For the same reason, when a disturbance such as a counter-force from a cam, for example, is inputted to the controlled object, the sensibility of the switching function σ to the disturbance can be improved, and the switching function σ can be calculated as a value which appropriately reflects the influence of the disturbance, so that the control stability can be ensured for the disturbance. Further, for the same reason, a change in the following error e can be more accurately controlled at a converging rate specified by the switching line. From the foregoing, the controllability can be improved over the prior art in a transient state in which the actual cam phase CAIN converges to the target cam phase CAINCMD.

Figure 9:
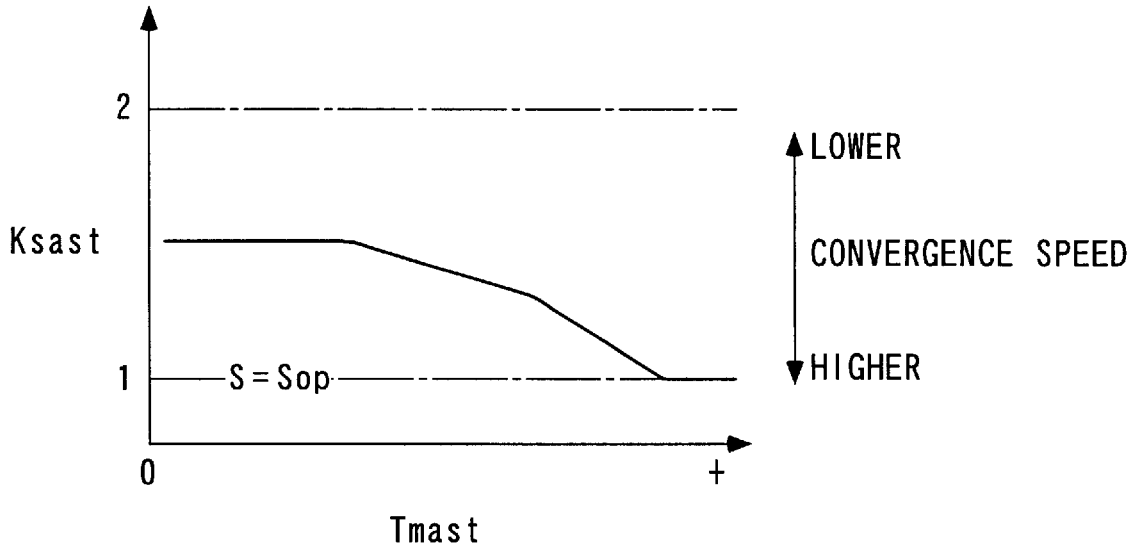
FIG. 9 is an exemplary table for use in setting a post-start correction coefficient Ksast.

Also, as shown in equation (13), the switching function setting parameter S is set as the product of the reference value Sop and post-start correction coefficient Ksast. As shown in FIG. 7, the reference value Sop is set to a smaller value as the differential pressure DOP (=OP-OPREF) is higher. It is therefore possible to prevent the actual cam phase CAIN from overshooting the target cam phase CAINCMD when OP>OPREF and to compensate for a response delay when OP<OPREF. Since the post-start correction coefficient Ksast is set to a larger value as the timer value Tmast is smaller as shown in FIG. 9, it is possible to appropriately converge the actual cam phase CAIN to the target cam phase CAINCMD while compensating the actual cam phase CAIN for an instable condition immediately after the start of the engine 3. As a result, the responsibility of the actual cam phase CAIN to the control input DUT can be held in a stable state to maintain the engine 3 in a stable operating condition.

The non-linear input Unl included in the control input DUT can limit the influence of modeling error and disturbance as well as compensate the controlled object for the non-linear characteristic. Particularly, when the gain G of the non-linear input Unl is scheduled to take the predetermined maximum value Gmax when the preceding value DUT(k−1) of the control input is within a predetermined range (−Dc≦DUT(k−1)≦Db) near zero, i.e., the actual cam phase CAIN exhibits the most instable behavior due to the characteristic of the electrically driven spool valve 12, the actual cam phase CAIN can be appropriately compensated for such an instable behavior. In addition, since the gain G is set in different manners in a positive region and a negative region of the control input DUT, the actual cam phase CAIN can be appropriately compensated for the responsibility which is different when the actual cam phase CAIN is advanced and when it is retarded in accordance with whether the actual cam phase CAIN is advanced or retarded.

The damping input Udamp included in the control input DUT can effectively prevent the actual cam phase CAIN from overshooting the target cam phase CAINCMD due to the inertia, compressibility of the oil, and the like of the hydraulic system when the target cam phase CAINCMD suddenly changes.

The adaptive law input Uadp included in the control input DUT can carry the time series data of the following error e on the switching line to converge the following error e to zero without fail while limiting the steady-state deviation of the controlled object, the modeling error, and the influence of disturbance. In other words, it is possible to ensure the control stability for the steady-state deviation of the controlled object, the modeling error, and disturbance. Particularly, since the gain G of the adaptive law input Uadp is set in accordance with the value of the switching function σ, the actual cam phase CAIN can be appropriately prevented from overshooting the target cam phase CAINCMD due to the integration characteristic of the adaptive law input Uadp.

The equivalent control input Ueq included in the control input DUT can securely restrict the time series data of the following error e on the switching line, thereby making it possible to converge the actual cam phase CAIN to the target cam phase CAINCMD without fail. Particularly, since the sampling period ΔTs of the actual cam phase CAIN is set longer than the control period ΔT, the dynamic characteristic of the actual cam phase CAIN near a frequency corresponding to the sampling frequency ΔTs can be appropriately reflected to the equivalent control input Ueq, even if the control input is determined at a control period corresponding to a frequency several times as high as a frequency range in which the actual cam phase CAIN is to be changed using the cam phase varying device 10 which exhibits an intense friction characteristic, thereby ensuring the control stability near the frequency corresponding to the sampling period ΔTs.

While the foregoing embodiment relies on the adaptive sliding mode control algorithm to control the actual cam phase CAIN, a method of controlling the actual cam phase CAIN is not limited to this, but any response specifying control may be employed instead. For example, the cam phase control apparatus may employ a back stepping control which can specify a converging behavior of the following error e by adjusting design parameters, in which case the aforementioned advantages can be provided with the employment of a method of setting the switching function σ similar to the foregoing embodiment.

Also, while the foregoing embodiment changes (sets) the switching function setting parameter S in accordance with the oil pressure OP for compensating for the influence of fluctuating oil pressure OP, a method of compensating for the influence of fluctuating oil pressure OP is not limited to this. Alternatively, the model parameters may be identified in accordance with the oil pressure OP when it changes. While the latter method could compensate for the influence of fluctuating oil pressure OP, this method encounters difficulties in ensuring the stability for the controller as compared with the method described in the embodiment. From this point of view, the foregoing embodiment employs the method of changing the switching function setting parameter S.

Further, while the foregoing embodiment employs the hydraulically driven cam phase varying device 10, the cam phase varying device 10 is not limited to this particular type, but any such device 10 may be employed as long as it can change the actual cam phase CAIN in accordance with the control input DUT. For example, the cam phase control apparatus may employ an electrically driven cam phase varying device which changes the actual cam phase CAIN by a driving force of an electric motor or a solenoid.

Further, while the foregoing embodiment has been described in connection with the control of the actual cam phase CAIN of the intake cam 6*a* using the cam phase varying mechanism 13, the cam phase varying mechanism 13 may be configured to control an actual cam phase of the exhaust cam 7*a* with respect to the crank shaft 8. It goes without saying that the cam phase varying mechanism 13 may be configured to control both the actual cam phases of the intake cam 6*a* and exhaust cam 7*a*.

As described above, the cam phase control apparatus for an internal combustion engine according to the present invention can improve the controllability in a transient state in which the actual cam phase converges to the target cam phase, and accurately and readily identify the model parameters even if a mechanism for changing the actual cam phase exhibits an intense friction characteristic.

What is claimed is:

1. A cam phase control apparatus for an internal combustion engine for controlling an actual cam phase of at least one of an intake cam and an exhaust cam with respect to a crank shaft, said apparatus comprising:

cam phase varying means for changing said actual cam phase;

cam phase detecting means for detecting said actual cam phase;

operating condition detecting means for detecting an operating condition of said internal combustion engine;

target cam phase setting means for setting a target cam phase in accordance with the detected operating condition; and control means relying on a response specifying control algorithm to determine a control input to said cam phase varying means at a predetermined control period for converging said actual cam phase to said target cam phase, said response specifying control algorithm configured to model a controlled object which receives the control input to said cam phase varying means and outputs said actual cam phase, said controlled object being represented by a discrete time based model.

2. A cam phase control apparatus for an internal combustion engine according to claim 1, further comprising:

sampling means for sampling said control input and said actual cam phase at a predetermined sampling period longer than said control period, wherein said discrete time based model comprises said sampled control input, and time series data of said sampled actual cam phase.

3. A cam phase control apparatus for an internal combustion engine according to claim 2, wherein:

said sampling means samples a deviation of said actual cam phase from said target cam phase at said predetermined sampling period, and said control means determines said control input in accordance with a response specifying control algorithm for creating a switching function as a function of time series data of said sampled deviation.

4. A cam phase control apparatus for an internal combustion engine according to claim 1, wherein said response specifying control algorithm is a sliding mode control algorithm.

5. A cam phase control apparatus for an internal combustion engine according to claim 4, wherein said control input comprises a total sum of a plurality of inputs, each of which is determined in accordance with at least one of a value of said switching function and said actual cam phase.

6. A cam phase control apparatus for an internal combustion engine according to claim 5, wherein said plurality of inputs include a reaching law input proportional to the value of said switching function.

7. A cam phase control apparatus for an internal combustion engine according to claim 5, wherein said plurality of inputs include a non-linear input which is set inverse in sign to the value of said switching function.

8. A cam phase control apparatus for an internal combustion engine according to claim 5, wherein said cam phase varying means comprises:

an electrically driven spool valve including two hydraulic systems for outputting separate oil pressures respectively from an oil pressure source, and a spool valve body movable within a predetermined movable range including a neutral position at which a differential pressure between the oil pressures in said two hydraulic systems is zero, said spool valve being responsive to said control input for moving said spool valve body within said movable range to change the differential pressure between the oil pressures in said two hydraulic systems; and a cam phase varying mechanism for changing said actual cam phase in accordance with the differential pressure between the oil pressures in said two hydraulic systems outputted from said electrically movable spool valve, wherein said plurality of inputs include a non-linear input which is set inverse in sign to the value of said switching function, said non-linear input having a gain which is set in accordance with the differential pressure between the oil pressures in said two hydraulic systems.

9. A cam phase control apparatus for an internal combustion engine according to claim 8, wherein said gain of said non-linear input is set to a larger value when the differential pressure between the oil pressures in said two hydraulic systems is within a predetermined range including zero than when the differential pressure is not within said predetermined range.

10. A cam phase control apparatus for an internal combustion engine according to claim 5, wherein said plurality of inputs include a damping input which is proportional to a rate at which said actual cam phase is changed.

11. A cam phase control apparatus for an internal combustion engine according to claim 5, wherein said plurality of inputs include an adaptive law input which is proportional to an integrated value of said switching function.

12. A cam phase control apparatus for an internal combustion engine according to claim 11, wherein said adaptive law input has a gain which is set in accordance with the value of said switching function.

13. A cam phase control apparatus for an internal combustion engine according to claim 5, wherein said plurality of inputs include an equivalent control input which is determined based on a plurality of values of actual cam phases sequentially sampled at said predetermined sampling period.

14. A cam phase control apparatus for an internal combustion engine according to claim 5, wherein said plurality of inputs include at least one input which has a gain scheduled in different manners from each other when said actual cam phase is advanced and when said actual cam phase is retarded.

15. A cam phase control apparatus for an internal combustion engine according to claim 3, wherein:

said cam phase varying means is configured to change said actual cam phase with an oil pressure supplied from an oil pressure source, at least one of the time series data of said deviation making up said switching function is multiplied by a multiplication coefficient, and said multiplication coefficient is set in accordance with the oil pressure supplied from said oil pressure source to said cam phase varying means.

16. A cam phase control apparatus for an internal combustion engine according to claim 15, wherein said multiplication coefficient is set such that said deviation decreases at a lower rate as a differential pressure between said oil pressure and a predetermined reference pressure is larger.

17. A cam phase control apparatus for an internal combustion engine according to claim 15, wherein:

said oil pressure source supplies said cam phase varying means with an oil used in said internal combustion engine, and said multiplication coefficient is set such that said deviation decreases at a lower rate as a shorter time has elapsed from a start of said internal combustion engine.

18. A cam phase control apparatus for an internal combustion engine according to claim 3, wherein:

said cam phase varying means is configured to change said actual cam phase with an oil supplied from an oil pressure source for use by said internal combustion engine, at least one of the time series data of said deviation making up said switching function is multiplied by a multiplication coefficient, and said multiplication coefficient is set such that said deviation decreases at a lower rate as a shorter time has elapsed from a start of said internal combustion engine.

19. A cam phase control apparatus for an internal combustion engine for controlling an actual cam phase of at least one of an intake cam and an exhaust cam with respect to a crank shaft, said apparatus comprising:

cam phase varying means for changing said actual cam phase;

cam phase detecting means for detecting said actual cam phase;

operating condition detecting means for detecting an operating condition of said internal combustion engine;

target cam phase setting means for setting a target cain phase in accordance with the detected operating condition;

sampling means for sampling a deviation of said detected actual cam phase from said set target cam phase at a predetermined sampling period; and control means relying on a response specifying control algorithm for creating a switching function as a function of time series data of said sampled deviation to determine a control input to said cam phase varying means at a predetermined control period for converging said actual cam phase to said target cam phase.

20. A cam phase control apparatus for an internal combustion engine according to claim 19, wherein said predetermined sampling period is set longer than said control period.

21. A cam phase control apparatus for an internal combustion engine according to claim 19, wherein said response specifying control algorithm is a sliding mode control algorithm.

22. A cam phase control apparatus for an internal combustion engine according to claim 21, wherein said control input comprises a total sum of a plurality of inputs, each of which is determined in accordance with at least one of a value of said switching function and said actual cam phase.

23. A cam phase control apparatus for an internal combustion engine according to claim 22, wherein said plurality of inputs include a reaching law input proportional to the value of said switching function.

24. A cam phase control apparatus for an internal combustion engine according to claim 22, wherein said plurality of inputs include a non-linear input which is set inverse in sign to the value of said switching function.

25. A cam phase control apparatus for an internal combustion engine according to claim 22, wherein said cam phase varying means comprises:

an electrically driven spool valve including two hydraulic systems for outputting separate oil pressures respectively from an oil pressure source, and a spool valve body movable within a predetermined movable range including a neutral position at which a differential pressure between the oil pressures in said two hydraulic systems is zero, said spool valve being responsive to said control input for moving said spool valve body within said movable range to change the differential pressure between the oil pressures in said two hydraulic systems; and a cam phase varying mechanism for changing said actual cam phase in accordance with the differential pressure between the oil pressures in said two hydraulic systems outputted from said electrically movable spool valve, wherein said plurality of inputs include a non-linear input which is set inverse in sign to the value of said switching function, said non-linear input having a gain which is set in accordance with the differential pressure between the oil pressures in said two hydraulic systems.

26. A cam phase control apparatus for an internal combustion engine according to claim 25, wherein said gain of said non-linear input is set to a larger value when the differential pressure between the oil pressures in said two hydraulic systems is within a predetermined range including zero than when the differential pressure is not within said predetermined range.

27. A cam phase control apparatus for an internal combustion engine according to claim 22, wherein said plurality of inputs include a damping input which is proportional to a rate at which said actual cam phase is changed.

28. A cam phase control apparatus for an internal combustion engine according to claim 22, wherein said plurality of inputs include an adaptive law input which is proportional to an integrated value of said switching function.

29. A cam phase control apparatus for an internal combustion engine according to claim 28, wherein said adaptive law input has a gain which is set in accordance with the value of said switching function.

30. A cam phase control apparatus for an internal combustion engine according to claim 22, wherein:

said sampling means further samples said actual cam phase at said predetermined sampling period, and said plurality of inputs include an equivalent control input which is determined based on a plurality of values of actual cam phases sequentially sampled at said predetermined sampling period.

31. A cam phase control apparatus for an internal combustion engine according to claim 22, wherein said plurality of inputs include at least one input which has a gain scheduled in different manners from each other when said actual cam phase is advanced and when said actual cam phase is retarded.

32. A cam phase control apparatus for an internal combustion engine according to claim 19, wherein:

said cam phase varying means is configured to change said actual cam phase with an oil pressure supplied from an oil pressure source, at least one of the time series data of said deviation making up said switching function is multiplied by a multiplication coefficient, and said multiplication coefficient is set in accordance with the oil pressure supplied from said oil pressure source to said cam phase varying means.

33. A cam phase control apparatus for an internal combustion engine according to claim 32, wherein said multiplication coefficient is set such that said deviation decreases at a lower rate as a differential pressure between said oil pressure and a predetermined reference pressure is larger.

34. A cam phase control apparatus for an internal combustion engine according to claim 32, wherein:

said oil pressure source supplies said cam phase varying means with an oil used in said internal combustion engine, and said multiplication coefficient is set such that said deviation decreases at a lower rate as a shorter time has elapsed from a start of said internal combustion engine.

35. A cam phase control apparatus for an internal combustion engine according to claim 19, wherein:

said cam phase varying means is configured to change said actual cam phase with an oil supplied from an oil pressure source for use by said internal combustion engine, at least one of the time series data of said deviation making up said switching function is multiplied by a multiplication coefficient, and said multiplication coefficient is set such that said deviation decreases at a lower rate as a shorter time has elapsed from a start of said internal combustion engine.

36. A cam phase control apparatus for an internal combustion engine for controlling an actual cam phase of at least one of an intake cam and an exhaust cam with respect to a crank shaft, said apparatus comprising:

a cam phase varying module for changing said actual cam phase;

a cam phase detecting module for detecting said actual cam phase;

an operating condition detecting module for detecting an operating condition of said internal combustion engine;

a target cam phase setting module for setting a target cam phase in accordance with the detected operating condition; and a control module relying on a response specifying control algorithm to determine a control input to said cam phase varying device at a predetermined control period for converging said actual cam phase to said target cam phase, said response specifying control algorithm configured to model a controlled object which receives the control input to said cam phase varying device and outputs said actual cam phase, said controlled object being represented by a discrete time based model.

37. A cam phase control apparatus for an internal combustion engine according to claim 36, further comprising:

a sampling module for sampling said control input and said actual cam phase at a predetermined sampling period longer than said control period, wherein said discrete time based model comprises said sampled control input, and time series data of said sampled actual cam phase.

38. A cam phase control apparatus for an internal combustion engine according to claim 37, wherein:

said sampling module samples a deviation of said actual cam phase from said target cam phase at said predetermined sampling period, and said control module determines said control input in accordance with a response specifying control algorithm for creating a switching function as a function of time series data of said sampled deviation.

39. A cam phase control apparatus for an internal combustion engine according to claim 36, wherein said response specifying control algorithm is a sliding mode control algorithm.

40. A cam phase control apparatus for an internal combustion engine according to claim 39, wherein said control input comprises a total sum of a plurality of inputs, each of which is determined in accordance with at least one of a value of said switching function and said actual cam phase.

41. A cam phase control apparatus for an internal combustion engine according to claim 40, wherein said plurality of inputs include a reaching law input proportional to the value of said switching function.

42. A cam phase control apparatus for an internal combustion engine according to claim 40, wherein said plurality of inputs include a non-linear input which is set inverse in sign to the value of said switching function.

43. A cam phase control apparatus for an internal combustion engine according to claim 40, wherein said cam phase varying device comprises:

an electrically driven spool valve including two hydraulic systems for outputting separate oil pressures respectively from an oil pressure source, and a spool valve body movable within a predetermined movable range including a neutral position at which a differential pressure between the oil pressures in said two hydraulic systems is zero, said spool valve being responsive to said control input for moving said spool valve body within said movable range to change the differential pressure between the oil pressures in said two hydraulic systems; and a cam phase varying mechanism for changing said actual cam phase in accordance with the differential pressure between the oil pressures in said two hydraulic systems outputted from said electrically movable spool valve, wherein said plurality of inputs include a non-linear input which is set inverse in sign to the value of said switching function, said non-linear input having a gain which is set in accordance with the differential pressure between the oil pressures in said two hydraulic systems.

44. A cam phase control apparatus for an internal combustion engine according to claim 43, wherein said gain of said non-linear input is set to a larger value when the differential pressure between the oil pressures in said two hydraulic systems is within a predetermined range including zero than when the differential pressure is not within said predetermined range.

45. A cam phase control apparatus for an internal combustion engine according to claim 40, wherein said plurality of inputs include a damping input which is proportional to a rate at which said actual cam phase is changed.

46. A cam phase control apparatus for an internal combustion engine according to claim 40, wherein said plurality of inputs include an adaptive law input which is proportional to an integrated value of said switching function.

47. A cam phase control apparatus for an internal combustion engine according to claim 46, wherein said adaptive law input has a gain which is set in accordance with the value of said switching function.

48. A cam phase control apparatus for an internal combustion engine according to claim 40, wherein said plurality of inputs include an equivalent control input which is determined based on a plurality of values of actual cam phases sequentially sampled at said predetermined sampling period.

49. A cam phase control apparatus for an internal combustion engine according to claim 40, wherein said plurality of inputs include at least one input which has a gain scheduled in different manners from each other when said actual cam phase is advanced and when said actual cam phase is retarded.

50. A cam phase control apparatus for an internal combustion engine according to claim 38, wherein:

said cam phase varying device is configured to change said actual cam phase with an oil pressure supplied from an oil pressure source, at least one of the time series data of said deviation making up said switching function is multiplied by a multiplication coefficient, and said multiplication coefficient is set in accordance with the oil pressure supplied from said oil pressure source to said cam phase varying device.

51. A cam phase control apparatus for an internal combustion engine according to claim 50, wherein said multiplication coefficient is set such that said deviation decreases at a lower rate as a differential pressure between said oil pressure and a predetermined reference pressure is larger.

52. A cam phase control apparatus for an internal combustion engine according to claim 50, wherein:

said oil pressure source supplies said cam phase varying device with an oil used in said internal combustion engine, and said multiplication coefficient is set such that said deviation decreases at a lower rate as a shorter time has elapsed from a start of said internal combustion engine.

53. A cam phase control apparatus for an internal combustion engine according to claim 38, wherein:

said cam phase varying device is configured to change said actual cam phase with an oil supplied from an oil pressure source for use by said internal combustion engine, at least one of the time series data of said deviation making up said switching function is multiplied by a multiplication coefficient, and said multiplication coefficient is set such that said deviation decreases at a lower rate as a shorter time has elapsed from a start of said internal combustion engine.

54. A cam phase control apparatus for an internal combustion engine for controlling an actual cam phase of at least one of an intake cam and an exhaust cam with respect to a crank shaft, said apparatus comprising:

a cam phase varying device for changing said actual cam phase;

a cam phase detecting module for detecting said actual cam phase;

an operating condition detecting module for detecting an operating condition of said internal combustion engine;

a target cam phase setting module for setting a target cam phase in accordance with the detected operating condition;

a sampling module for sampling a deviation of said detected actual cam phase from said set target cam phase at a predetermined sampling period; and a control module relying on a response specifying control algorithm for creating a switching function as a function of time series data of said sampled deviation to determine a control input to said cam phase varying device at a predetermined control period for converging said actual cam phase to said target cam phase.

55. A cam phase control apparatus for an internal combustion engine according to claim 54, wherein said predetermined sampling period is set longer than said control period.

56. A cam phase control apparatus for an internal combustion engine according to claim 54, wherein said response specifying control algorithm is a sliding mode control algorithm.

57. A cam phase control apparatus for an internal combustion engine according to claim 56, wherein said control input comprises a total sum of a plurality of inputs, each of which is determined in accordance with at least one of a value of said switching function and said actual cam phase.

58. A cam phase control apparatus for an internal combustion engine according to claim 57, wherein said plurality of inputs include a reaching law input proportional to the value of said switching function.

59. A cam phase control apparatus for an internal combustion engine according to claim 57, wherein said plurality of inputs include a non-linear input which is set inverse in sign to the value of said switching function.

60. A cam phase control apparatus for an internal combustion engine according to claim 57, wherein said cam phase varying device comprises:

an electrically driven spool valve including two hydraulic systems for outputting separate oil pressures respectively from an oil pressure source, and a spool valve body movable within a predetermined movable range including a neutral position at which a differential pressure between the oil pressures in said two hydraulic systems is zero, said spool valve being responsive to said control input for moving said spool valve body within said movable range to change the differential pressure between the oil pressures in said two hydraulic systems; and a cam phase varying mechanism for changing said actual cam phase in accordance with the differential pressure between the oil pressures in said two hydraulic systems outputted from said electrically movable spool valve, wherein said plurality of inputs include a non-linear input which is set inverse in sign to the value of said switching function, said non-linear input having a gain which is set in accordance with the differential pressure between the oil pressures in said two hydraulic systems.

61. A cam phase control apparatus for an internal combustion engine according to claim 60, wherein said gain of said non-linear input is set to a larger value when the differential pressure between the oil pressures in said two hydraulic systems is within a predetermined range including zero than when the differential pressure is not within said predetermined range.

62. A cam phase control apparatus for an internal combustion engine according to claim 57, wherein said plurality of inputs include a damping input which is proportional to a rate at which said actual cam phase is changed.

63. A cam phase control apparatus for an internal combustion engine according to claim 57, wherein said plurality of inputs include an adaptive law input which is proportional to an integrated value of said switching function.

64. A cam phase control apparatus for an internal combustion engine according to claim 63, wherein said adaptive law input has a gain which is set in accordance with the value of said switching function.

65. A cam phase control apparatus for an internal combustion engine according to claim 57, wherein:

said sampling module further samples said actual cam phase at said predetermined sampling period, and said plurality of inputs include an equivalent control input which is determined based on a plurality of values of actual cam phases sequentially sampled at said predetermined sampling period.

66. A cam phase control apparatus for an internal combustion engine according to claim 57, wherein said plurality of inputs include at least one input which has a gain scheduled in different manners from each other when said actual cam phase is advanced and when said actual cam phase is retarded.

67. A cam phase control apparatus for an internal combustion engine according to claim 54, wherein:

said cam phase varying device is configured to change said actual cam phase with an oil pressure supplied from an oil pressure source, at least one of the time series data of said deviation making up said switching function is multiplied by a multiplication coefficient, and said multiplication coefficient is set in accordance with the oil pressure supplied from said oil pressure source to said cam phase varying device.

68. A cam phase control apparatus for an internal combustion engine according to claim 67, wherein said multiplication coefficient is set such that said deviation decreases at a lower rate as a differential pressure between said oil pressure and a predetermined reference pressure is larger.

69. A cam phase control apparatus for an internal combustion engine according to claim 67, wherein:

said oil pressure source supplies said cam phase varying device with an oil used in said internal combustion engine, and said multiplication coefficient is set such that said deviation decreases at a lower rate as a shorter time has elapsed from a start of said internal combustion engine.

70. A cam phase control apparatus for an internal combustion engine according to claim 54, wherein:

said cam phase varying device is configured to change said actual cam phase with an oil supplied from an oil pressure source for use by said internal combustion engine, at least one of the time series data of said deviation making up said switching function is multiplied by a multiplication coefficient, and said multiplication coefficient is set such that said deviation decreases at a lower rate as a shorter time has elapsed from a start of said internal combustion engine.

71. A cam phase control method for an internal combustion engine for controlling an actual cam phase of at least one of an intake cam and an exhaust cam with respect to a crank shaft, said method comprising the steps of:

changing said actual cam phase;

detecting said actual cam phase;

detecting an operating condition of said internal combustion engine;

setting a target cam phase in accordance with the detected operating condition; and determining a control input at a predetermined control period in accordance with a response specifying control algorithm for converging said actual cam phase to said target cam phase, said response specifying control algorithm configured to model a controlled object which receives the control input and outputs said actual cam phase, said controlled object being represented by a discrete time based model.

72. A cam phase control method for an internal combustion engine according to claim 71, further comprising the step of:

sampling said control input and said actual cam phase at a predetermined sampling period longer than said control period, wherein said discrete time based model comprises said sampled control input, and time series data of said sampled actual cam phase.

73. A cam phase control method for an internal combustion engine according to claim 72, wherein:

said step of sampling includes sampling a deviation of said actual cam phase from said target cam phase at said predetermined sampling period, and said step of controlling includes determining said control input in accordance with a response specifying control algorithm for creating a switching function as a function of time series data of said sampled deviation.

74. A cam phase control method for an internal combustion engine according to claim 71, wherein said response specifying control algorithm is a sliding mode control algorithm.

75. A cam phase control method for an internal combustion engine according to claim 74, wherein said control input comprises a total sum of a plurality of inputs, each of which is determined in accordance with at least one of a value of said switching function and said actual cam phase.

76. A cam phase control method for an internal combustion engine according to claim 75, wherein said plurality of inputs include a reaching law input proportional to the value of said switching function.

77. A cam phase control method for an internal combustion engine according to claim 75, wherein said plurality of inputs include a non-linear input which is set inverse in sign to the value of said switching function.

78. A cam phase control method for an internal combustion engine according to claim 75, wherein said step of changing said actual cam phase includes:

changing a differential pressure between oil pressures in two hydraulic systems from an oil pressure source in response to said control input; and changing said actual cam phase in accordance with the differential pressure between the oil pressures in said two hydraulic systems, wherein said plurality of inputs include a non-linear input which is set inverse in sign to the value of said switching function, said non-linear input having a gain which is set in accordance with the differential pressure between the oil pressures in said two hydraulic systems.

79. A cam phase control method for an internal combustion engine according to claim 78, wherein said gain of said non-linear input is set to a larger value when the differential pressure between the oil pressures in said two hydraulic systems is within a predetermined range including zero than when the differential pressure is not within said predetermined range.

80. A cam phase control method for an internal combustion engine according to claim 75, wherein said plurality of inputs include a damping input which is proportional to a rate at which said actual cam phase is changed.

81. A cam phase control method for an internal combustion engine according to claim 75, wherein said plurality of inputs include an adaptive law input which is proportional to an integrated value of said switching function.

82. A cam phase control method for an internal combustion engine according to claim 81, wherein said adaptive law input has a gain which is set in accordance with the value of said switching function.

83. A cam phase control method for an internal combustion engine according to claim 75, wherein said plurality of inputs include an equivalent control input which is determined based on a plurality of values of actual cam phases sequentially sampled at said predetermined sampling period.

84. A cam phase control method for an internal combustion engine according to claim 75, wherein said plurality of inputs include at least one input which has a gain scheduled in different manners from each other when said actual cam phase is advanced and when said actual cam phase is retarded.

85. A cam phase control method for an internal combustion engine according to claim 73, wherein:

said step of changing said actual cam phase includes changing said actual cam phase with an oil pressure supplied from an oil pressure source, at least one of the time series data of said deviation making up said switching function is multiplied by a multiplication coefficient, and said multiplication coefficient is set in accordance with the oil pressure supplied from said oil pressure source.

86. A cam phase control method for an internal combustion engine according to claim 85, wherein said multiplication coefficient is set such that said deviation decreases at a lower rate as a differential pressure between said oil pressure and a predetermined reference pressure is larger.

87. A cam phase control method for an internal combustion engine according to claim 85, wherein:

said oil pressure source supplies an oil used in said internal combustion engine, and said multiplication coefficient is set such that said deviation decreases at a lower rate as a shorter time has elapsed from a start of said internal combustion engine.

88. A cam phase control method for an internal combustion engine according to claim 73, wherein:

said step of changing said actual cam phase includes changing said actual cam phase with an oil supplied from an oil pressure source for use by said internal combustion engine, at least one of the time series data of said deviation making up said switching function is multiplied by a multiplication coefficient, and said multiplication coefficient is set such that said deviation decreases at a lower rate as a shorter time has elapsed from a start of said internal combustion engine.

89. A cam phase control method for an internal combustion engine for controlling an actual cam phase of at least one of an intake cam and an exhaust cam with respect to a crank shaft, said method comprising the steps of:

changing said actual cam phase;

detecting said actual cam phase;

detecting an operating condition of said internal combustion engine;

setting a target cam phase in accordance with the detected operating condition;

sampling a deviation of said detected actual cam phase from said set target cam phase at a predetermined sampling period; and determining a control input at a predetermined control period in accordance with a response specifying control algorithm for creating a switching function as a function of time series data of said sampled deviation for converging said actual cam phase to said target cam phase.

90. A cam phase control method for an internal combustion engine according to claim 89, wherein said predetermined sampling period is set longer than said control period.

91. A cam phase control method for an internal combustion engine according to claim 89, wherein said response specifying control algorithm is a sliding mode control algorithm.

92. A cam phase control method for an internal combustion engine according to claim 91, wherein said control input comprises a total sum of a plurality of inputs, each of which is determined in accordance with at least one of a value of said switching function and said actual cam phase.

93. A cam phase control method for an internal combustion engine according to claim 92, wherein said plurality of inputs include a reaching law input proportional to the value of said switching function.

94. A cam phase control method for an internal combustion engine according to claim 92, wherein said plurality of inputs include a non-linear input which is set inverse in sign to the value of said switching function.

95. A cam phase control method for an internal combustion engine according to claim 92, wherein said step of changing said actual cam phase includes:

changing a differential pressure between oil pressures in two hydraulic systems from an oil pressure source in response to said control input; and changing said actual cam phase in accordance with the differential pressure between the oil pressures in said two hydraulic systems, wherein said plurality of inputs include a non-linear input which is set inverse in sign to the value of said switching function, said non-linear input having a gain which is set in accordance with the differential pressure between the oil pressures in said two hydraulic systems.

96. A cam phase control method for an internal combustion engine according to claim 95, wherein said gain of said non-linear input is set to a larger value when the differential pressure between the oil pressures in said two hydraulic systems is within a predetermined range including zero than when the differential pressure is not within said predetermined range.

97. A cam phase control method for an internal combustion engine according to claim 92, wherein said plurality of inputs include a damping input which is proportional to a rate at which said actual cam phase is changed.

98. A cam phase control method for an internal combustion engine according to claim 92, wherein said plurality of inputs include an adaptive law input which is proportional to an integrated value of said switching function.

99. A cam phase control method for an internal combustion engine according to claim 98, wherein said adaptive law input has a gain which is set in accordance with the value of said switching function.

100. A cain phase control method for an internal combustion engine according to claim 92, wherein:

said step of sampling further includes sampling said actual cam phase at said predetermined sampling period, and said plurality of inputs include an equivalent control input which is determined based on a plurality of values of actual cam phases sequentially sampled at said predetermined sampling period.

101. A cam phase control method for an internal combustion engine according to claim 92, wherein said plurality of inputs include at least one input which has a gain scheduled in different manners from each other when said actual cam phase is advanced and when said actual cam phase is retarded.

102. A cam phase control method for an internal combustion engine according to claim 99, wherein:

said step of changing said actual cam phase includes changing said actual cam phase with an oil pressure supplied from an oil pressure source, at least one of the time series data of said deviation making up said switching function is multiplied by a multiplication coefficient, and said multiplication coefficient is set in accordance with the oil pressure supplied from said oil pressure source.

103. A cam phase control method for an internal combustion engine according to claim 102, wherein said multiplication coefficient is set such that said deviation decreases at a lower rate as a differential pressure between said oil pressure and a predetermined reference pressure is larger.

104. A cam phase control method for an internal combustion engine according to claim 102, wherein:

said oil pressure source supplies an oil used in said internal combustion engine, and said multiplication coefficient is set such that said deviation decreases at a lower rate as a shorter time has elapsed from a start of said internal combustion engine.

105. A cam phase control method for an internal combustion engine according to claim 99, wherein:

said step of changing said actual cam phase includes changing said actual cam phase with an oil supplied from an oil pressure source for use by said internal combustion engine, at least one of the time series data of said deviation making up said switching function is multiplied by a multiplication coefficient, and said multiplication coefficient is set such that said deviation decreases at a lower rate as a shorter time has elapsed from a start of said internal combustion engine.

106. An engine control unit including a control program for causing a computer to carry out control of actual cam phase of at least one of an intake cam and an exhaust cam with respect to a crank shaft in an internal combustion engine, wherein:

said control program causes the computer to change said actual cam phase; detect said actual cam phase; detect an operating condition of said internal combustion engine; set a target cam phase in accordance with the detected operating condition; and determine a control input at a predetermined control period in accordance with a response specifying control algorithm for converging said actual cam phase to said target cam phase, said response specifying control algorithm configured to model a controlled object which receives the control input and outputs said actual cam phase, said controlled object being represented by a discrete time based model.

107. An engine control unit according to claim 106, wherein said control program further causes the computer to sample said control input and said actual cam phase at a predetermined sampling period longer than said control period, wherein said discrete time based model comprises said sampled control input, and time series data of said sampled actual cam phase.

108. An engine control unit according to claim 107, wherein said control program further causes the computer to sample a deviation of said actual cam phase from said target cam phase at said predetermined sampling period, and determine said control input in accordance with a response specifying control algorithm for creating a switching function as a function of time series data of said sampled deviation.

109. An engine control unit according to claim 106, wherein said response specifying control algorithm is a sliding mode control algorithm.

110. An engine control unit according to claim 109, wherein said control input comprises a total sum of a plurality of inputs, each of which is determined in accordance with at least one of a value of said switching function and said actual cam phase.

111. An engine control unit according to claim 110, wherein said plurality of inputs include a reaching law input proportional to the value of said switching function.

112. An engine control unit according to claim 110, wherein said plurality of inputs include a non-linear input which is set inverse in sign to the value of said switching function.

113. An engine control unit according to claim 110, wherein said control program further causes the computer to change a differential pressure between oil pressures in two hydraulic systems from an oil pressure source in response to said control input; and change said actual cam phase in accordance with the differential pressure between the oil pressures in said two hydraulic systems, wherein said plurality of inputs include a non-linear input which is set inverse in sign to the value of said switching function, said non-linear input having a gain which is set in accordance with the differential pressure between the oil pressures in said two hydraulic systems.

114. An engine control unit according to claim 113, wherein said gain of said non-linear input is set to a larger value when the differential pressure between the oil pressures in said two hydraulic systems is within a predetermined range including zero than when the differential pressure is not within said predetermined range.

115. An engine control unit according to claim 110, wherein said plurality of inputs include a damping input which is proportional to a rate at which said actual cam phase is changed.

116. An engine control unit according to claim 110, wherein said plurality of inputs include an adaptive law input which is proportional to an integrated value of said switching function.

117. An engine control unit according to claim 116, wherein said adaptive law input has a gain which is set in accordance with the value of said switching function.

118. An engine control unit according to claim 110, wherein said plurality of inputs include an equivalent control input which is determined based on a plurality of values of actual cam phases sequentially sampled at said predetermined sampling period.

119. An engine control unit according to claim 110, wherein said plurality of inputs include at least one input which has a gain scheduled in different manners from each other when said actual cam phase is advanced and when said actual cam phase is retarded.

120. An engine control unit according to claim 108, wherein said control program further causes the computer to change said actual cam phase with an oil pressure supplied from an oil pressure source, multiply at least one of the time series data of said deviation making up said switching function by a multiplication coefficient, and set said multiplication coefficient in accordance with the oil pressure supplied from said oil pressure source.

121. An engine control unit according to claim 120, wherein said multiplication coefficient is set such that said deviation decreases at a lower rate as a differential pressure between said oil pressure and a predetermined reference pressure is larger.

122. An engine control unit according to claim 120, wherein:

said oil pressure source supplies an oil used in said internal combustion engine, and said multiplication coefficient is set such that said deviation decreases at a lower rate as a shorter time has elapsed from a start of said internal combustion engine.

123. An engine control unit according to claim 108, wherein said control program further causes the computer to change said actual cam phase with an oil supplied from an oil pressure source for use by said internal combustion engine, multiply at least one of the time series data of said deviation making up said switching function by a multiplication coefficient, and set said multiplication coefficient such that said deviation decreases at a lower rate as a shorter time has elapsed from a start of said internal combustion engine.

124. An engine control unit including a control program for causing a computer to carry out control of actual cam phase of at least one of an intake cam and an exhaust cam with respect to a crank shaft in an internal combustion engine, wherein:

said control program causes the computer to change said actual cam phase; detect said actual cam phase; detect an operating condition of said internal combustion engine; set a target cam phase in accordance with the detected operating condition; sample a deviation of said detected actual cam phase from said set target cam phase at a predetermined sampling period; and determine a control input at a predetermined control period in accordance with a response specifying control algorithm for creating a switching function as a function of time series data of said sampled deviation for converging said actual cam phase to said target cam phase.

125. An engine control unit according to claim 124, wherein said predetermined sampling period is set longer than said control period.

126. An engine control unit according to claim 124, wherein said response specifying control algorithm is a sliding mode control algorithm.

127. An engine control unit according to claim 126, wherein said control input comprises a total sum of a plurality of inputs, each of which is determined in accordance with at least one of a value of said switching function and said actual cam phase.

128. An engine control unit according to claim 127, wherein said plurality of inputs include a reaching law input proportional to the value of said switching function.

129. An engine control unit according to claim 127, wherein said plurality of inputs include a non-linear input which is set inverse in sign to the value of said switching function.

130. An engine control unit according to claim 127, wherein said control program further causes the computer to change a differential pressure between oil pressures in two hydraulic systems from an oil pressure source in response to said control input; and change said actual cam phase in accordance with the differential pressure between the oil pressures in said two hydraulic systems, wherein said plurality of inputs include a non-linear input which is set inverse in sign to the value of said switching function, said non-linear input having a gain which is set in accordance with the differential pressure between the oil pressures in said two hydraulic systems.

131. An engine control unit according to claim 130, wherein said gain of said non-linear input is set to a larger value when the differential pressure between the oil pressures in said two hydraulic systems is within a predetermined range including zero than when the differential pressure is not within said predetermined range.

132. An engine control unit according to claim 127, wherein said plurality of inputs include a damping input which is proportional to a rate at which said actual cam phase is changed.

133. An engine control unit according to claim 127, wherein said plurality of inputs include an adaptive law input which is proportional to an integrated value of said switching function.

134. An engine control unit according to claim 133, wherein said adaptive law input has a gain which is set in accordance with the value of said switching function.

135. An engine control unit according to claim 127, wherein said control program further causes the computer to sample said actual cam phase at said predetermined sampling period, and said plurality of inputs include an equivalent control input which is determined based on a plurality of values of actual cam phases sequentially sampled at said predetermined sampling period.

136. An engine control unit according to claim 127, wherein said plurality of inputs include at least one input which has a gain scheduled in different manners from each other when said actual cam phase is advanced and when said actual cam phase is retarded.

137. An engine control unit according to claim 134, wherein said control program further causes the computer to change said actual cam phase with an oil pressure supplied from an oil pressure source, multiply at least one of the time series data of said deviation making up said switching function by a multiplication coefficient, and set said multiplication coefficient in accordance with the oil pressure supplied from said oil pressure source.

138. An engine control unit according to claim 137, wherein said multiplication coefficient is set such that said deviation decreases at a lower rate as a differential pressure between said oil pressure and a predetermined reference pressure is larger.

139. An engine control unit according to claim 137, wherein:

said oil pressure source supplies an oil used in said internal combustion engine, and said multiplication coefficient is set such that said deviation decreases at a lower rate as a shorter time has elapsed from a start of said internal combustion engine.

140. An engine control unit according to claim 134, wherein said control program further causes the computer to change said actual cam phase with an oil supplied from an oil pressure source for use by said internal combustion engine, multiply at least one of the time series data of said deviation making up said switching function by a multiplication coefficient, and set said multiplication coefficient such that said deviation decreases at a lower rate as a shorter time has elapsed from a start of said internal combustion engine.

* * * * *